US006173918B1

(12) United States Patent
Koike et al.

(10) Patent No.: US 6,173,918 B1
(45) Date of Patent: Jan. 16, 2001

(54) VENEER REELING APPARATUS

(75) Inventors: Masaru Koike; Yukinobu Kuno, both of Aichi (JP)

(73) Assignee: Meinan Machinery Works, Inc., Aichi (JP)

( * ) Notice: Under 35 U.S.C. 154(b), the term of this patent shall be extended for 0 days.

(21) Appl. No.: 09/151,443

(22) Filed: Sep. 11, 1998

(30) Foreign Application Priority Data

Sep. 12, 1997 (JP) ..... 9-268143
Dec. 11, 1997 (JP) ..... 9-362659
Jun. 11, 1998 (JP) ..... 10-181691

(51) Int. Cl.[7] ..... B65H 18/08; B65H 18/14

(52) U.S. Cl. ..... 242/534; 242/541.3; 242/541.5; 242/541.6

(58) Field of Search ..... 242/534, 541.3, 242/542.3, 541.5, 541.6

(56) References Cited

U.S. PATENT DOCUMENTS 4,181,269 1/1980 Ketteler et al. .
4,969,609 * 11/1990 Schenta ..... 242/542.3
4,995,563 * 2/1991 Kalin ..... 242/541.3
5,988,558 * 11/1999 Koike et al. ..... 242/534

FOREIGN PATENT DOCUMENTS 57-53306 3/1982 (JP) .

* cited by examiner

*Primary Examiner*—John Q. Nguyen
(74) *Attorney, Agent, or Firm*—Morgan & Finnegan, L.L.P.

(57) ABSTRACT

A veneer reeling apparatus for winding a veneer sheet around a freely rotatable take-up reel into a veneer roll. Veneer sheet is transferred by a plurality of spaced conveyer belts extending below the take-up reel. The take-up reel is removably supported by movable reel carriages for movement therewith toward and away from the conveyer belts. Each belts is urged toward the take-up reel to be kept in resiliently pressing contact with veneer roll for friction driving. There is provided a detector for monitoring an increment in diameter of the veneer roll during reeling operation and generating a signal in response to the detection of a predetermined amount of increment in the roll diameter and for detecting the force with which a roll member presses against the veneer roll and for generating a signal upon detection of a predetermined force in response to an increase in diameter of the veneer roll. A control responding to the signal from the detector provides a command signal to move the reel carriages hence the take-up reel carried thereby upward or away from the belt so as to compensate for the increment in diameter of the veneer roll.

8 Claims, 14 Drawing Sheets

VENEER REELING APPARATUS

FIELD OF THE INVENTION

The present invention relates to an apparatus for winding or reeling a sheet of wood veneer into a roll while the sheet is being transferred to the apparatus with its fiber orientation directed perpendicularly to the direction in which the sheet is transferred.

BACKGROUND OF THE INVENTION

For understanding of underlying problems of the invention, firstly reference is made to FIG. 28 schematically showing a conventional veneer reeling apparatus which is disclosed by Publication of Unexamined Japanese Patent Application (Kokai) 57-53306 of 1982.

This apparatus has a plurality of endless belts 141 for conveying veneer sheet 140, each trained round a driven front pulley 145 disposed swingable as indicated by double-headed arrow about a pivotal axis defined by a rear pulley (not shown) located on opposite side of the belts 141. The reeling apparatus further includes a take-up reel 143 extending above the upper legs of the belts 141 for winding thereround veneer sheet 140 into a roll 144 and a plurality of sectional touch rolls 142 mounted on a shaft provided just below the reel 143. Each sectional touch roll 142 is located between any two adjacent belts 141 and driven to rotate at a peripheral speed that is slightly higher than the traveling speed of the conveyer belts 141. The shaft carrying the touch rolls 142 is resiliently supported, as indicated by double-headed arrow, and urged so as to make the touch rolls 142 to be in pressing contact with veneer roll 144.

In the above apparatus, veneer reeling is accomplished by rotating the veneer roll 144 by frictional force from the touch rolls 142 pressed thereagainst with a force that is large enough to effect the rotation. Because the veneer roll 144 and the touch rolls 142 are engaged substantially in circle-to-circle contact and hence the length of contact therebetween as seen in veneer conveying direction is rather short, the magnitude of stress resulting from the contact and acting on a unit area between the touch roll 142 and the veneer roll 144 is disadvantageously large. Consequently, the veneer sheet 140 is subjected at the point of contact to a stress that tends to strain or deform the sheet.

On the other hand, a veneer sheet 140 as peeled by a veneer lathe (not shown) comes out therefrom inherently in such a form that the sheet is waved at short intervals. Further, veneer sheet 140 is formed in the lower surface thereof with a number of small cracks, usually called "lathe checks", produced during peeling operation. Thus, veneer sheet generally tends to be deformed easily when it receives an external force and, because a wood veneer sheet is of heterogeneous quality, such deformation takes place variably from one location thereof to another along the line of contact between the veneer sheet and the touch rolls 142 even when it is subjected to application of the same force.

When subjected to the above straining or deforming stress at the touch rolls 142, however, veneer sheet 140 is stretched or extended in the region upstream of the touch rolls 142. Because this extension takes place variably from one location to another of the veneer sheet 140 across the direction in which it is moved, sheet movement tends to be deviated from a straightforward course along the belts 141, with the result that veneer sheet 140 may collide against a frame of the reeling apparatus, thus causing a damage to veneer sheet 140. Furthermore, any excessive extension of veneer sheet 140 causes slack in the sheet 140 as indicated by 140*a*, which may result in formation of folds. If such folds in the veneer sheet 140 are wound round the roll 144, the sheet 140 is broken at bends of the folds, thereby affecting the veneer quality and yield.

SUMMARY OF THE INVENTION

Therefore, it is an object of the invention to provide a veneer reeling apparatus which makes possible smooth reeling operation without allowing veneer sheet to be folded or deviated from its intended course along conveyer belts so that damage to veneer sheet and reduction in veneer yield as described above are prevented.

According to the present invention, there is provided an apparatus for reeling or winding veneer sheet round a freely rotatable take-up reel into a roll, comprising a plurality of spaced conveyer belts extending below the take-up reel perpendicularly to the axis of the reel and driven to move in the direction that advances veneer sheet placed on the belts toward the take-up reel. The apparatus further includes means for moving the take-up reel toward and away from the belts, means for urging each of the belts toward the take-up reel to keep the belts in resiliently pressing contact with the veneer roll thereby to friction drive the latter, and also means for detecting an increment in diameter of the veneer roll during reeling operation. The detecting means is operable to generate a signal in response to detection of a predetermined amount of increment in diameter of the veneer roll. The apparatus further has a control which is operable in response to the signal from the detecting means to generate a command signal to activate the reel moving means thereby to move the take-up reel away from the belts so as to compensate for the increment.

In a preferred embodiment, the urging means includes an air cylinder operable to keep each of the belts in resiliently pressing contact with the veneer roll with a predetermined force, while the take-up reel moving means includes a pair of synchronously movable carriages removably supporting the take-up reel at its opposite end portions, gearing engaged with the carriages and a motor for driving the gearing in response to the above command from the control thereby to move the carriages synchronously upward.

In order to prevent the take-up reel from being elevated because of the presence of a debris, such as piece of veneer, which may cause a partial increase in the roll diameter, the control generates the above command signal to activate the reel moving means only when the take-up reel has continued to rotate for a predetermined length of time since the detecting means generated the signal to the control. In the preferred embodiment of the invention, this predetermined length of time corresponds to a quarter of a complete turn of the take-up reel.

The reeling apparatus of the preferred embodiment further comprises a roll member or a touch roll disposed below the take-up reel and the belts and extending in parallel relation to the reel. The roll member has a plurality of roll sections formed at locations corresponding to spaces between any two adjacent belts and urged so that these roll sections are resiliently pressed against the veneer roll. Further, the roll member is movable away from the take-up reel as the veneer roll increases its diameter during reeling operation. In case of the embodiment employing the roll member, a load cell which is operable in conjunction with the movement of the roll member relative to the take-up reel may be used as means for detecting the increment in diameter of veneer roll.

In case of an embodiment wherein the detecting means is arranged to detect the diametrical increment of veneer roll by determining a predetermined amount of movement of at least one belt from a predetermined position thereof, a limit switch may be used which is disposed to be operated by such movement of the belt.

Alternatively, according to the present invention, the take-up reel may be disposed stationary and, instead of the above reel moving means, any means for moving the belts toward and away from the take-up reel may be employed. In such a case, the control responding to a signal from the detecting means transmits a command signal to activate the above belt moving means so that the increment in diameter of the veneer roll is compensated for.

The above and other objects, features and advantages of the invention will become apparent to those skilled in the art from the following description of embodiments of the veneer reeling apparatus according to the present invention, which description is made with reference to the accompanying drawings, wherein:

DETAILED DESCRIPTION OF PREFERRED EMBODIMENTS

Figure 1:
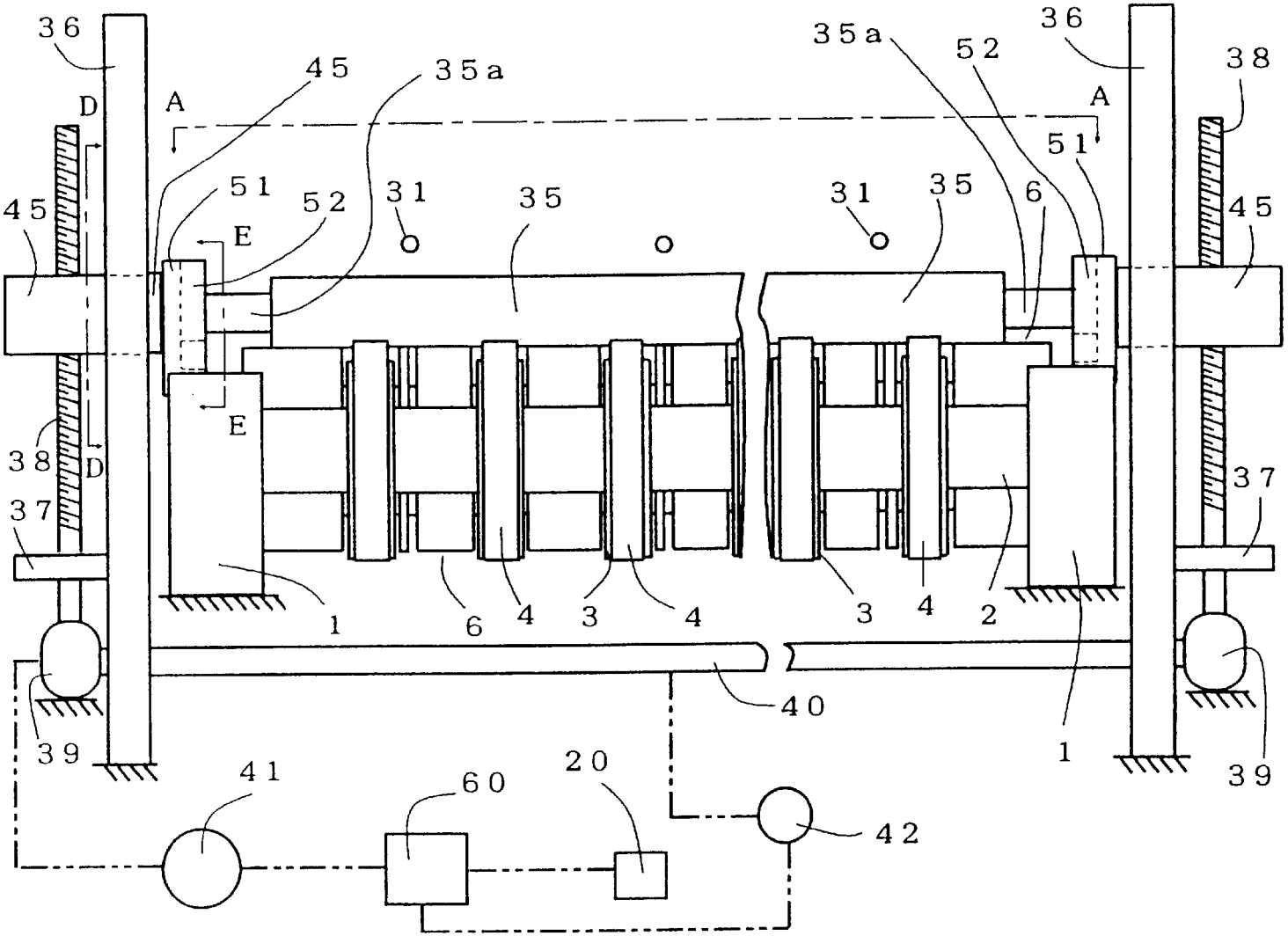
FIG. 1 is a front view of a preferred embodiment of veneer reeling apparatus constructed according to the present invention.
Figure 2:
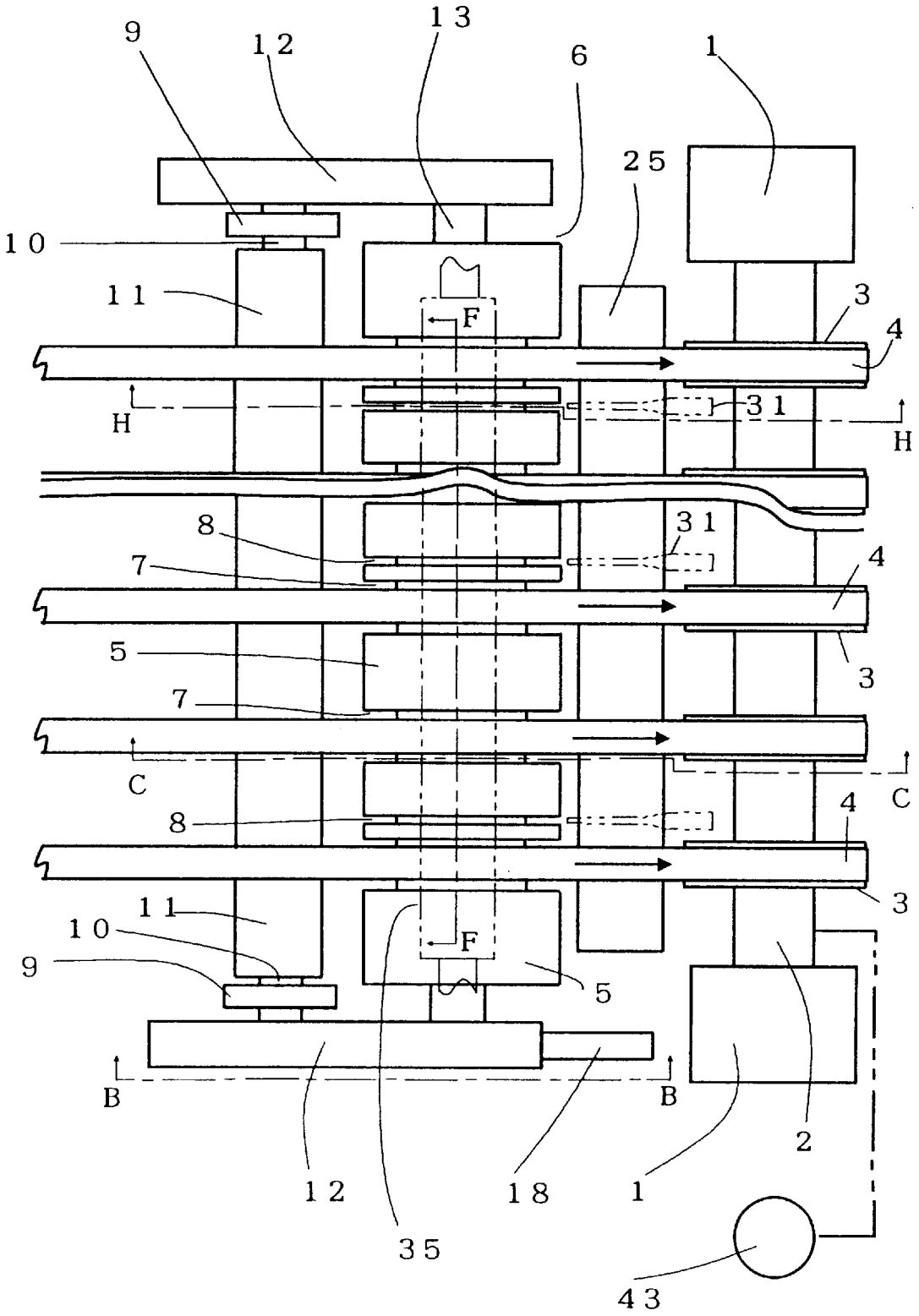
FIG. 2 is a fragmentary plan view as seen in arrow direction from dash-and-dot line A—A of FIG. 1.

Reference is made to the accompanying drawings, specifically to FIGS. 1 to 15 showing a first preferred embodiment of the present invention. As shown in FIGS. 1 and 2, the veneer reeling apparatus includes a plurality of spaced endless conveyer belts 4, or eight belts in the illustrated embodiment, each trained round a front pulley 3 mounted on a common drive shaft 2 rotatably supported by bearings 1 fixedly mounted to a frame and driven by a motor (not shown). Each belt 4 is also trained round a rear pulley (not shown) mounted on a freely rotatable shaft (not shown either), so that a veneer sheet 65 (FIG. 11) placed on the belts 4 is transferred forward as indicated by arrows in FIG. 2. As schematically shown in FIG. 2, a rotary encoder 43 is operatively connected to the drive shaft 2 for monitoring the rotational speed of the shaft 2 and hence the traveling speed of the conveyer belts 4. Though not shown in FIG. 2, the rotary encoder 43 is operatively connected to a control 60 shown in FIG. 1.

The apparatus further has a take-up reel 35 extending above and across the upper legs of the belts 4 for winding thereround a veneer sheet 65 (FIG. 11) into a roll 66 (FIG. 13) and a touch roll assembly 6. The latter assembly 6 includes a freely rotatable shaft 13 located upstream of the front pulley shaft 2 and a plurality of spaced touch rolls 5 carried on the shaft 13. The touch rolls 5 are clad with urethane rubber covering and spaced from one another such that annular grooves 7 and 8 are formed between any two adjacent touch rolls 5, as most clearly shown in FIG. 2, so as to provide spaces for the belts 4 to run and the tip end of a thread nozzle 31 to enter, as will be described in a later part hereof.

Figure 4:
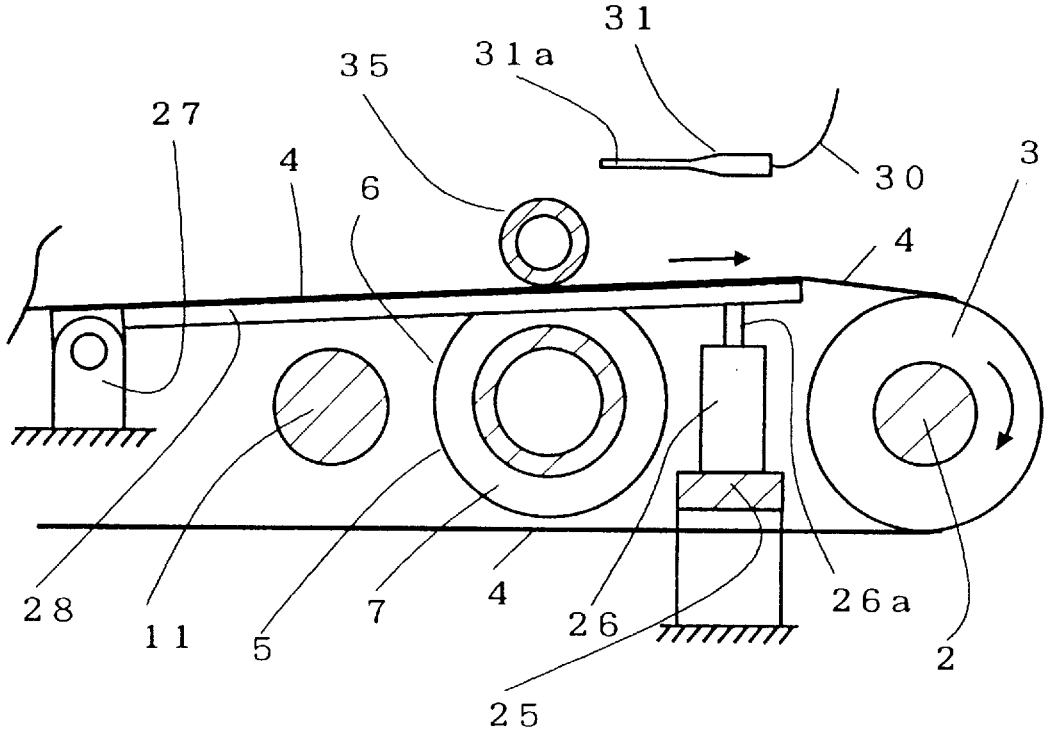
FIG. 4 is a fragmentary side view as seen in arrow direction from dash-and-dot line C—C of FIG. 2.

As shown in FIGS. 2 and 4, upstream of the touch roll assembly 6 is located a bar 11 mounted on a shaft 10 rotatably supported at opposite ends thereof by bearings 9 fixed to a frame (not shown) of the apparatus. The shaft 10 carries at each end thereof a swingable first arm 12 for rotation with the shaft 10.

Figure 3:
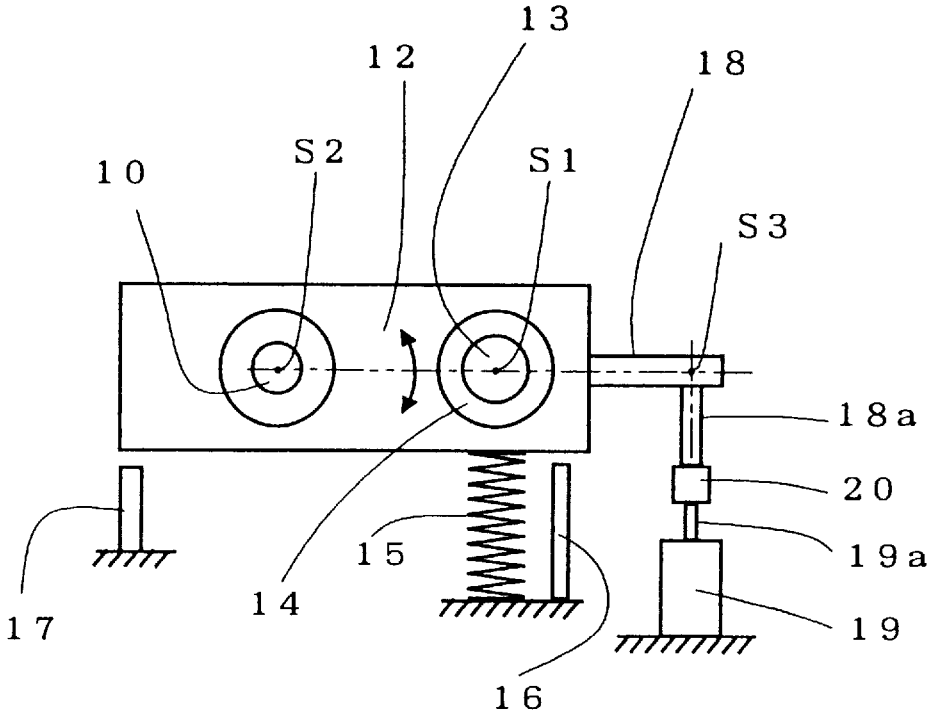
FIG. 3 is a schematic side view showing part of the apparatus of FIG. 1, as seen in arrow direction from dash-and-dot line B—B of FIG. 2.

As shown in FIG. 3, the shaft 13 of the touch roll assembly 6 is rotatably supported at the opposite ends thereof by bearings 14 provided in the first arms 12, so that the shaft 13 is vertically movable with swinging motion of the first arms 12 about the shaft 10. An L-shaped second arm 18 having a vertical portion 18*a* is fixedly mounted to one of the first arms 12, or the right-hand side arm as viewed in veneer conveying direction. There is provided a compression spring 15 between each first arm 12 and frame of the apparatus for supporting the first and second arms 12, 18 and the touch roll assembly 6 such that the first arms 12 are maintained in a substantially horizontal position. Reference numerals 16 and 17 designate stops for limiting rotation of the first arm 12 in clockwise and counterclockwise directions, respectively.

Just below the vertical portion 18*a* of L-shaped second arm 18 is located a pneumatic cylinder 19 with a piston rod 19*a* having fixed at its outer end a load cell 20 which is operatively connected to the control 60. The cylinder 19 is charged with air under pressure the magnitude of which is such that the piston rod 19*a* exerts a predetermined upward force to the second arm 18 via the load cell 20 that allows the touch rolls 5 to be pressed against the take-up reel 35, or veneer roll 66 (FIG. 13) when such a roll has been already formed, with a force of about 5 kilograms. Such predetermined upward force effected by thus charging the air cylinder 19 shall be referred to as "set upward force" hereinafter.

Incidentally, this "set upward force" may be obtained by charging the cylinder 19 with air under pressure acting on the piston rod 19*a* upwardly with a force that is equivalent to 5 kilograms times quotient obtained by dividing distance S1–S2 by distance S2–S3, wherein S1 and S2 denote axial centers of the shaft 13 of the touch roll assembly 6 and of the bar 11, respectively, as seen in FIG. 3, and S3 represents a point of intersection between an imaginary line connecting S1 and S2 and another imaginary line passing through the center of the vertical portion 18*a* of the second arm 18.

After air under the above pressure is charged in the cylinder 19, both inlet and outlet ports of the cylinder are sealingly closed with its piston rod 19*a* fully extended. By so doing, when an external force is applied to the load cell 20 to push the piston rod 19*a* downward, air within the cylinder 19 is compressed and, accordingly, the piston rod 19*a* exerts a reaction force in opposing or upward direction that is greater than the above set upward force and proportional to the magnitude of the above external force and hence to the distance for which the piston rod 19 is pushed. This reaction force is detected by the load cell 20, which in turn generates to the control 60*a* signal representative of such reaction force.

The vertical portion 18*a* and the piston rod 19*a* have longitudinal dimensions so that a slight clearance is formed therebetween when no external force is applied to the load cell 20.

Figure 7:
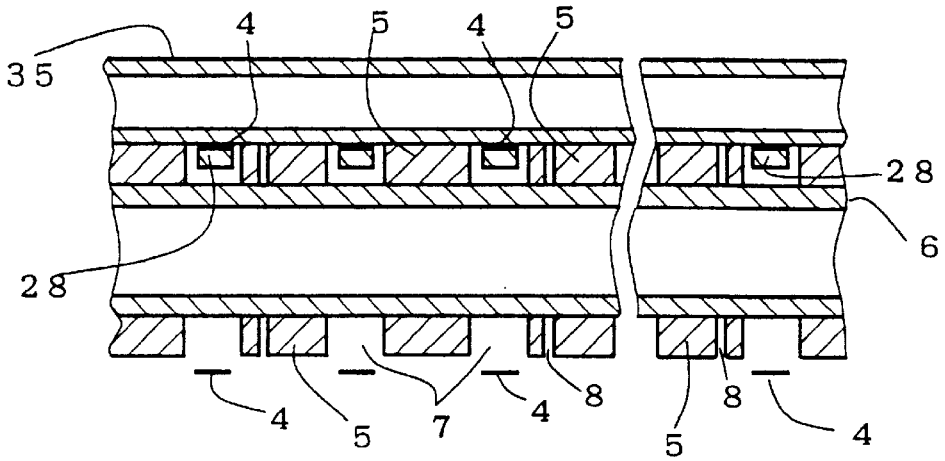
FIG. 7 is a fragmentary front view as seen in arrow direction from dash-and-dot line F—F of FIG. 2.

Referring now to FIGS. 2 and 4, there is provided a support base 25 extending between the front pulley 3 and the touch roll assembly 6 and straddling the lower legs of the conveyer belts 4. The support base 25 has an air cylinder 26 fixed thereto in association with each belt 4. Each belt 4 has on its inner surface a backup plate 28 having substantially the same width as the belt 4 and rotatably supported at the upstream end thereof by a bearing 27. Each cylinder 26 is charged with air under pressure, the magnitude of which is established, with the weight of the plate 28 taken into account, so that the piston rod 26*a* of the cylinder 26 pushes the plate 28 to such an extent that each belt 4 is pressed against the take-up reel 35, or veneer roll 66, with a predetermined upward force of about 2.5 kilograms, namely 20 kilograms by all eight belts 4. It is noted that, in initial state of the apparatus wherein the take-up reel 35 and the touch rolls 5 are located as shown in FIGS. 4 and 7, which initial state will be detailed in later part hereof, the piston rod 26*a* is extended partially out of its cylinder 26 and engaged in pressing contact with its associated plate 28 so that, when the take-up reel 35 is moved slightly upward, the piston rod 26*a* can extend further to keep contact engagement with the plate 28, thereby allowing the belts 4 to be in pressing contact with the reel 35. It is also noted that, unlike air cylinder 19, each air cylinder 26 is so arranged that the force with which each belt 4 presses against the take-up reel 35, or against veneer roll 66, will not be varied remarkably by slight movement of the piston rod 26*a* relative to its cylinder. Such arrangement may be accomplished by sealing the outlet port of the cylinder 26, but connecting the inlet port thereof to a reducing valve (not shown) with a relatively long hose so that a larger amount of air must be compressed by downward movement of the piston rod 26*a*.

As indicated by phantom lines in FIG. 2, a plurality of thread nozzles 31 is disposed adjacent the take-up reel 35 at locations corresponding to the respective grooves 8, each having a nozzle end 31*a* whose outer diameter is smaller than the width of the groove 8 so as to be inserted thereinto as required. The nozzle 31 is operable to initially eject a thread 30 by air jet issued from its end 31*a* and then to allow the thread 30 to be pulled out tautly during veneer reeling operation. Furthermore, each thread nozzle 31 is movable by any appropriate means such as air cylinder in both vertical and horizontal directions, as will be described more in detail later herein.

Referring back to FIG. 1, a pair of uprights 36 is located adjacent the opposite ends of the touch roll assembly 6, and a pair of screws 38 operatively connected by a shaft 40 via bevel gears 39 is provided adjacent the uprights 36. A servo-motor 41, which is operable from a signal transmitted by the control 60, is connected to one of the bevel gears 39 for rotating both screws 38 synchronously. A rotary encoder 42 is operatively connected to the shaft 40 for counting the number of rotations thereof thereby to determine the distance that the take-up reel 35 has moved from its initial state position as will be explained hereinafter. This rotary encoder 42 is also connected to the control 60.

Figure 5:
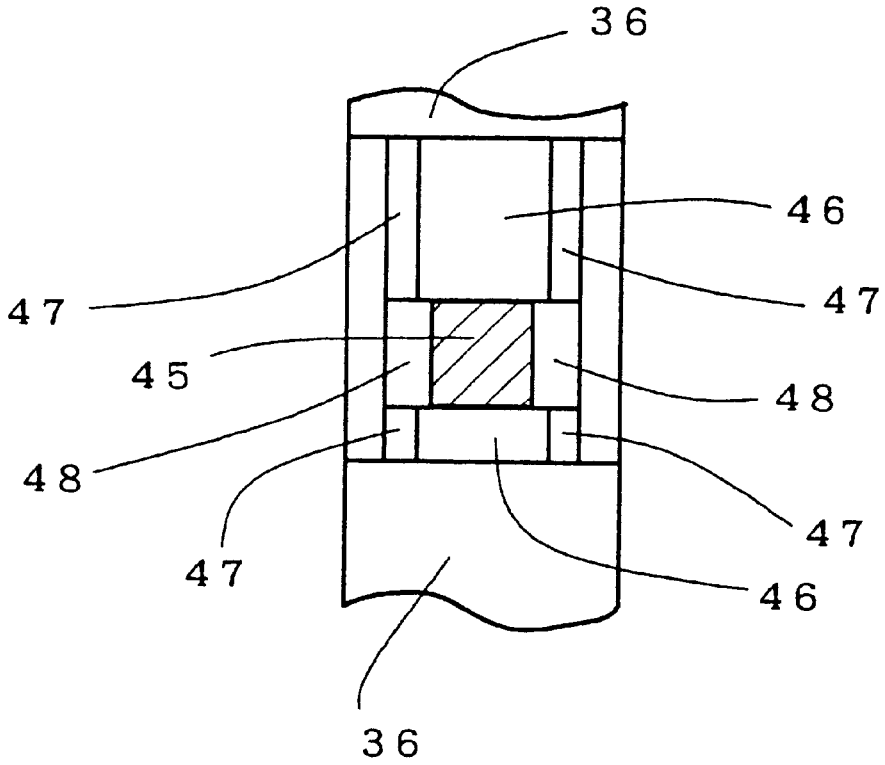
FIG. 5 is a fragmentary side view as seen in arrow direction from dash-and-dot line D—D of FIG. 1.
Figure 6:
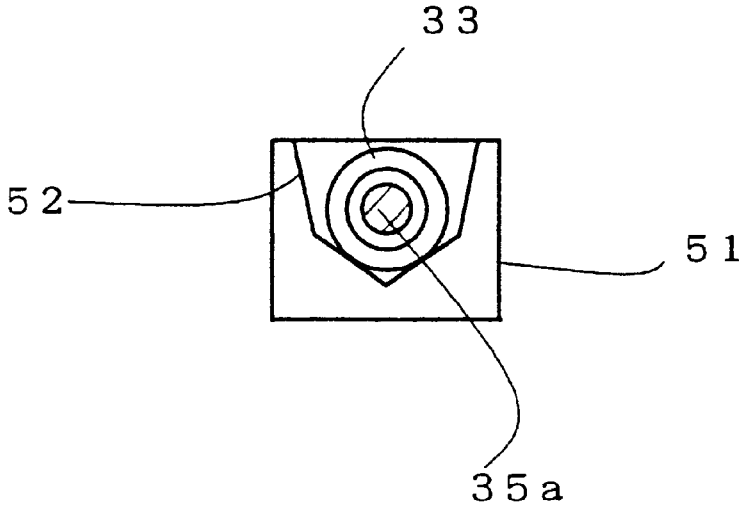
FIG. 6 is a schematic side view as seen in arrow direction from dash-and-dot line E—E of FIG. 1.

A support block 45 having formed therein internal thread (not shown) is engaged with each screw 38 and disposed through an opening 46 formed in each upright 36 for guided movement along vertical guide surfaces 47 by the aid of linear bearings 48 fixed to the support block 45, as shown in FIG. 5. A take-up reel carriage 51 is fixed to the inner end of each support block 45. The reel carriage 51 has formed therein a V-shaped support surface 52 for supporting a bearing 33 mounted at each end of a shaft 35*a* on which the take-up reel 35 is fixedly mounted, as schematically shown in FIG. 6. By so arranging, the take-up reel 35 is rotatable relative to the carriages 51 and movable vertically with the support blocks 45 along the screws 38 while maintaining parallel relationship to the touch roll shaft 13. As it is apparent to those skilled in the art, the take-up reel 35 is removably carried on the carriages 51.

The following will describe the manner in which the control 60 operates on the motor 41 for controllably driving the screws 38 thereby to move the take-up reel carriages 51.

When load detected by the load cell 20 is increased to exceed the above set upward force of the cylinder 19 by about 10 percent while the carriages 51 are moving downward with the pulley drive shaft 2 kept at a stop, which stop condition is detected by the rotary encoder 43, the control 60 then responding to a signal from the load cell 20 representative of such an increase of the load generates a signal commanding the motor 41 to stop and then to operate so as to rotate the screws 38 in the direction that causes the carriages 51 to be elevated until load detected by the load cell 20 becomes smaller than the set upward force of the cylinder 19.

On the other hand, when load detected by the load cell 20 is increased exceeding the set upward force of the cylinder 19 by about 10 percent while the pulley drive shaft 2 is being rotated and also if the detected load continues to be so while the take-up reel 35 rotates for a period of time corresponding to a predetermined rotation angle, e.g. a quarter of a complete turn of the reel 35, the control 60 generates a signal commanding the motor 41 to operate to rotate the screws 38 in the direction that causes the carriage 51 to be elevated. This elevation is continued until load detected by the load cell 20 becomes smaller than the set upward force of the cylinder 19 and also if this condition continues to be so while the take-up reel 35 makes a quarter turn.

While the conveyer belts 4 travel substantially at a constant speed, the time t during which the take-up reel 35 makes a quarter turn is lengthened with an increase in diameter of veneer roll 66. Incidentally, the time t can be figured out as follows. The distance that the outer periphery of veneer roll 66 moves during the length of time t is zt, wherein z represents the speed at which the belts 4 move, and the circumference of veneer roll 66 is expressed by $2\pi(x+y)$, wherein x represents the distance for which the carriages 51 are moved from their initial state position and y the radius of the reel 35, thus (x+y) represents the current radius of veneer roll 66. Since zt corresponds to a quarter of $2\pi(x+y)$, t is expressed by $2\pi(x+y)/2z$. In operation, the time t is calculated by the control 60 receiving information on the distance x measured by the rotary encoder 42 and the speed z monitored by the rotary encoder 43.

It is noted that the control 60 may be operable on the motor 41 from command signals generated by manual operation on a control panel by a machine operator, as will be explained in later part hereof.

The apparatus thus constructed is set in its initial state as follows.

With the pulley drive shaft 2 kept at a stop, the machine operator manually starts the motor 41 to rotate the screw 38 so as to bring the carriages 51 to a position higher than that shown in FIG. 1. Then, the take-up reel 35 is set in position by placing its bearings 33 on V-shaped support surfaces 52 of the carriages as shown in FIG. 6. The screws 38 are rotated by manually operating the motor 41 to lower the carriages 51 and the take-up reel 35 is brought into contact with the conveyer belts 4 and the touch rolls 5. By allowing the take-up reel 35 to move further downward, the touch rolls 5 and the belts 4 are forced downward and, therefore, the first arms 12 carrying the shaft 13 for the touch rolls 5 are caused to swing clockwise as seen in FIG. 3 and the lower end of the vertical portion 18*a* of the second arm 18 presses the load cell 20. Consequently, the piston rod 19*a* to which the load cell 20 is attached is pushed into the cylinder 19 and air under pressure in the cylinder 19 is compressed. Accordingly, the piston rod 19*a* is urged upward by a reaction force that is greater than the set upward force and the magnitude of which is commensurate to the extent of the above compression. Thus, the load cell 20 is subjected to a downward force from the second arm 18 and simultaneously to an upward force from the piston rod 19*a*.

As the load detected by the load cell 20 is further increased to exceed the set upward force by about 10 percent, the control 60 then responding to a signal representative of such an increase of the load generates a signal commanding the motor 41 to stop and then to operate so as to rotate the screws 38 in the direction that causes the take-up reel 35 to be elevated. As the take-up reel 35 is raised gradually, the force to push down the touch rolls 5 and hence the force acting on the load cell 20 is reduced and the piston rod 19*a* is allowed to move upward under the influence of compressed air in the cylinder 19 which is then greater than the set upward force. Therefore, the first arm 12 is swung in counterclockwise direction as seen in FIG. 3 and the touch roll assembly 6 carried by the first arm 12 is allowed to move upward while maintaining pressing contact with the take-up reel 35. As the piston rod 19*a* moves out of the cylinder 19 gradually, the force acting on the load cell 20 is reduced. As described earlier, when load detected by the load cell 20 becomes smaller than the set upward force of the cylinder 19, the control 60 generates a signal to stop the motor 41, thus stopping the upward movement of the reel carriages 51.

As a result of the above operational procedure for establishing the initial state of the apparatus, the take-up reel 35 is set in position as shown in FIG. 7. That is, the touch rolls 5 are engaged in pressing contact with the peripheral surface of the take-up reel 35 and the conveyer belts 4 urged by the cylinders 26 by way of the plates 28 are resiliently pressed against the reel 35.

The following will describe veneer reeling operation of the apparatus while referring to FIGS. 8 to 13.

Figure 8:
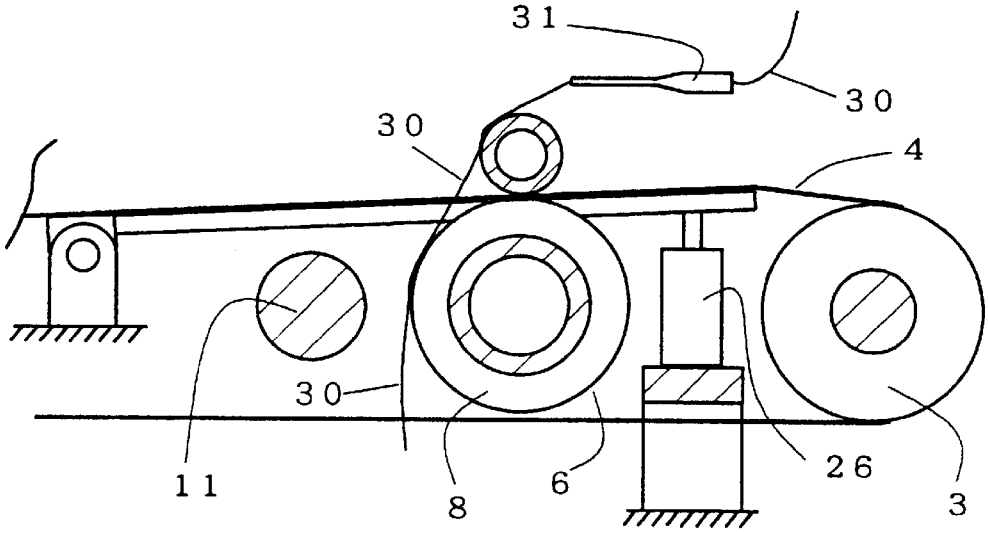
FIGS. 8 to 11 are fragmentary illustrative side views similar to that of FIG. 4, but showing movement of a thread nozzle of the apparatus.
Figure 9:
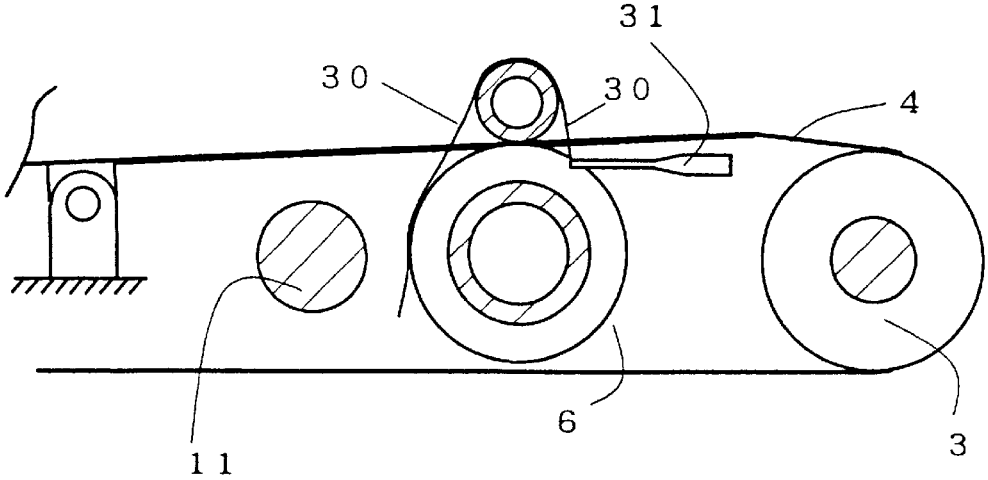
Figure 10:
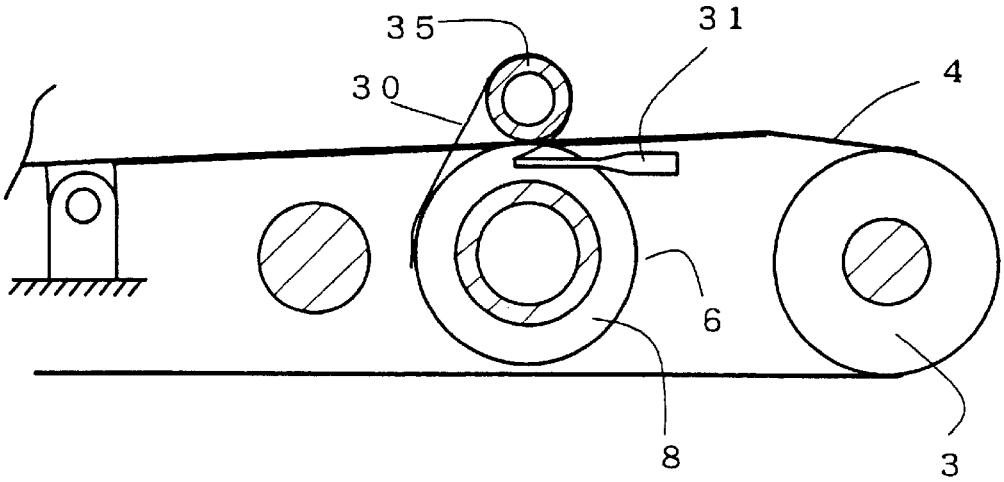

With the apparatus set in the above-described initial state shown in FIGS. 4 and 7, firstly each nozzle 31 is activated to issue an air jet with a thread 30 from the nozzle end 31*a* for a short period of time to allow the thread 30 to be positioned over the take-up reel 35 and the touch rolls 5 with its leading end located between the touch rolls 5 and the bar 11, as shown in FIG. 8. Subsequently, each nozzle 31 is moved down below the belts 4 as shown in FIG. 9 and then shifted horizontally to a position where the nozzle end 31*a* is located within the groove 8 just below the take-up reel 35 with the thread 30 drooping across the belts 4, as shown in FIG. 10. The above nozzle operations may be performed by manual operation on a control panel by the machine operator. With the thread 30 located as shown in FIG. 10, resistance is applied to the thread 30 at any appropriate position upstream of the nozzle end 31*a* so that the thread 30 is kept taut when it is pulled out of the nozzle. Then, the motor (not shown) for the front pulley shaft 2 is started to initiate conveying movement of the belts 4. Therefore, the take-up reel 35 against which the belts 4 are pressed is rotated by frictional force therebetween, while the touch rolls 5 engaged in contact with the reel 35 are also rotated by frictional force from the reel 35.

Figure 11:
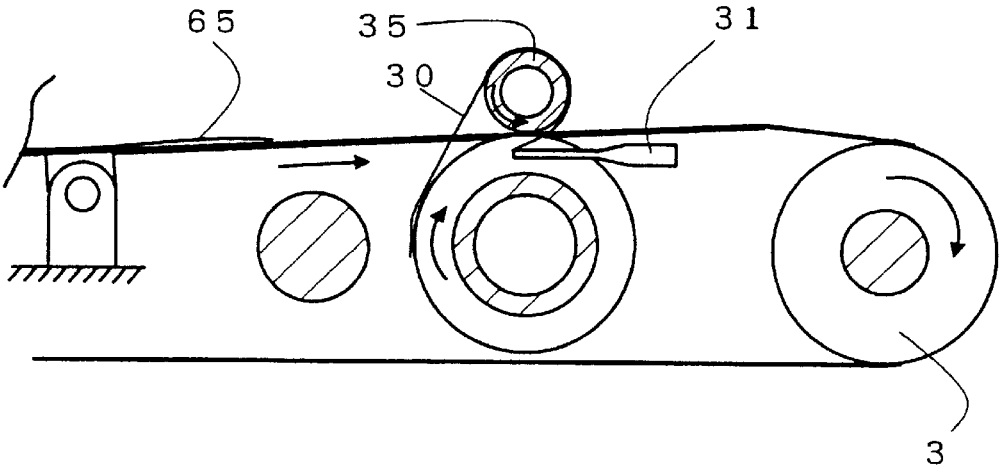
Figure 12:
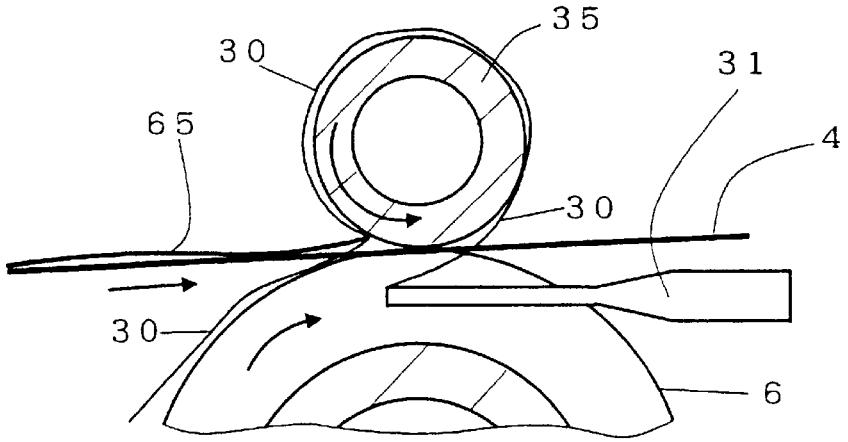
FIGS. 12 and 13 are fragmentary side illustrative views showing veneer reeling operation of the apparatus.
Figure 13:
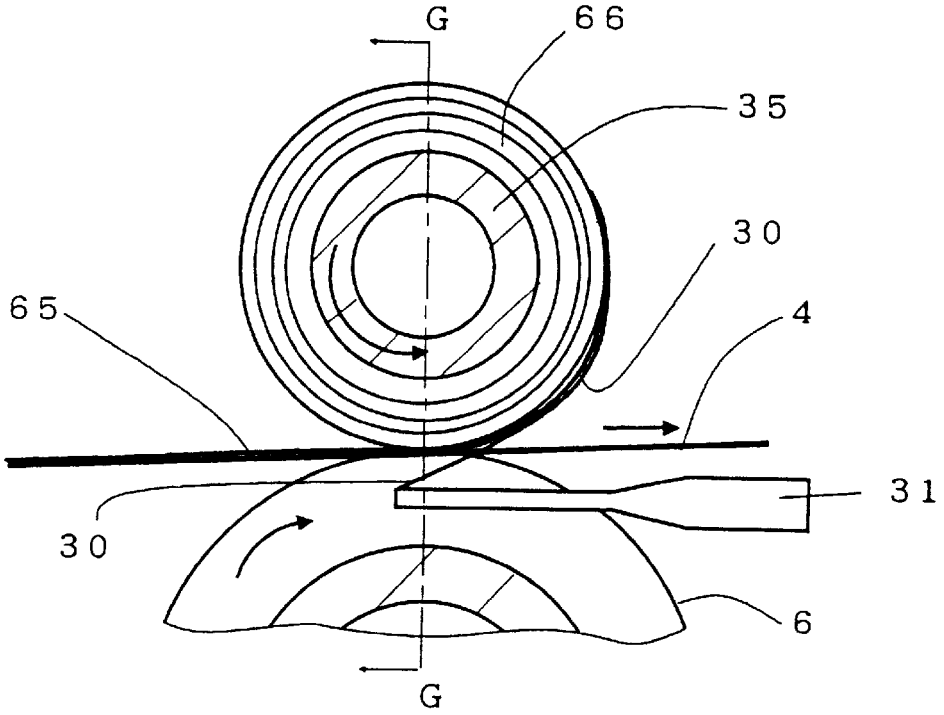

Referring to FIG. 11, reference numeral 65 designates a veneer sheet 65 peeled by a rotary veneer lathe (not shown) at a speed corresponding to the traveling speed of the conveyer belts 4 and having a nominal length of six feet (or about 1,800 mm) as measured along the fiber orientation of the wood veneer sheet 65, or across the direction in which the sheet 65 is moved on the belts 4. As the leading end of the veneer sheet 65 reaches the threads 30, the moving sheet 65 bends the threads 30 as shown in FIG. 12, and the sheet 63 passing between the take-up reel 35 and the touch rolls 5 is wound continuously round the reel 35 while being guided safely by the threads 30. Thus, a roll 66 of veneer sheet is formed round the take-up reel 35 as shown in FIG. 13.

As the reeling operation continues, the veneer roll diameter is increased progressively. Since the take-up reel 35 remains its current vertical position, the belts 4 and the touch rolls 5 are forced downward with an increase in diameter of the veneer roll 66. Therefore, the first arm 12 movable with the touch rolls 5 is swung clockwise as seen in FIG. 3, so that the load cell 20 is pushed and the piston rod 19*a* is moved gradually into the cylinder 19. Consequently, air in the cylinder 19 is compressed to increase the pressure therein, so that load detected by the load cell 20 becomes greater and eventually exceeds the set upward force.

If the load detected by the load cell 20 continues to be in excess of the set upward force by about 10 percent while the take-up reel 35 rotates a quarter of its complete turn, the control 60 generates a signal to the motor 41 to rotate the screws 38 in the direction that causes the carriage 51 to be elevated with the take-up reel 35 carried thereby. With the take-up reel 35 thus elevated, the pressure acting on the touch rolls 5 from veneer roll 66 is decreased and the first arm 12 is allowed to swing back in counterclockwise direction. The force exerted by the second arm portion 18*a* to the load cell 20 is also decreased. The elevation of the take-up reel 35 is continued until the load detected by the load cell 20 becomes smaller than the set upward force of the cylinder 19 and also if this condition continues to be so while the take-up reel 35 makes a quarter turn.

As it is now apparent from the foregoing, controllably elevating the take-up reel 35 in response to an increment in diameter of veneer roll 66 makes it possible to allow the touch rolls 5 to be pressed against the veneer roll 66 with an optimum force of about 5 kilograms.

On the other hand, the piston rod 26*a* acting on each conveyer belt 4 via plates 28 is also pushed into its associated cylinder 26 by an increase of reeled diameter of the veneer roll 66. However, since the upward force exerted by the cylinder 26 remains substantially constant as described earlier, the force acting on the veneer roll 66 from the belts 4 remains unchanged. Furthermore, when the carriages 51 are raised by the above motor operation, the piston rod 26*a* is extended back outward from its cylinder 26 to maintain its pressing contact with the plate 28, so that the belt 4 is kept in pressing contact with the veneer roll 66 for providing frictional force necessary for driving the roll 66.

Figure 28:
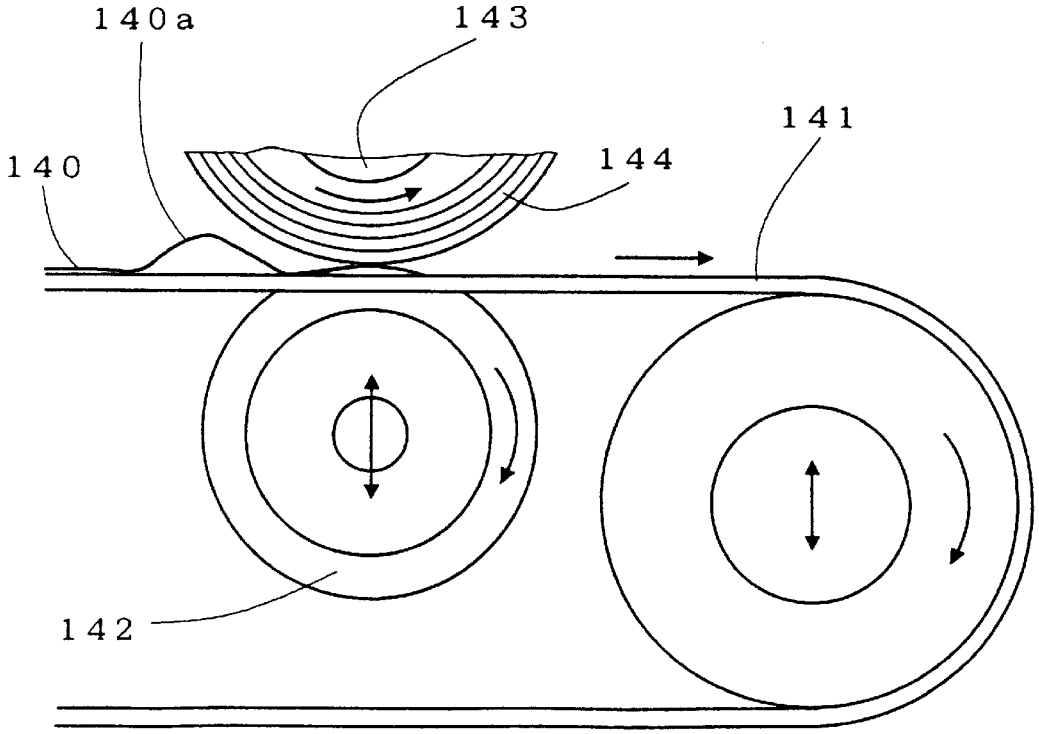
FIG.28 PRIOR ART
FIG. 28 shows a prior art veneer reeling apparatus.

As it is now apparent to those skilled in the art, veneer reeling operation is performed with the conveyer belts 4 and the touch roll 5 kept in pressing contact with veneer roll 66 and the force with which the touch rolls 5 are pressed against the veneer roll is constantly monitored by the load cell 20 and controlled to be maintained substantially constant. Additionally, veneer roll 66 is positively driven to rotate by frictional force from the belts 4, so that the length of line-to-circle contact therebetween as measured in veneer conveying direction is longer than circle-to-circle contact in the case of the conventional apparatus of FIG. 28. Therefore, the magnitude of stress applied to a unit area of veneer sheet is advantageously reduced and harmful stressing of veneer sheet as encountered in the conventional apparatus is prevented. Consequently, the problems as described earlier with reference to FIG. 28, such as deviation from a straightforward course along the belts 4 which may result in collision against a frame, formation of folds in veneer sheet causing breakage thereto can be solved successfully.

In winding a thin and hence weak veneer sheet with a thickness of about 0.6 mm, portions of the sheet between any two adjacent conveyer belts 4 tends to sag by its own weight, but such portions are pressed against veneer roll 66 with a moderate force by the touch rolls 5 clad with urethane rubber covering. Thus, smooth and stabilized reeling operation is achieved in handling a thin veneer sheet.

Figure 14:
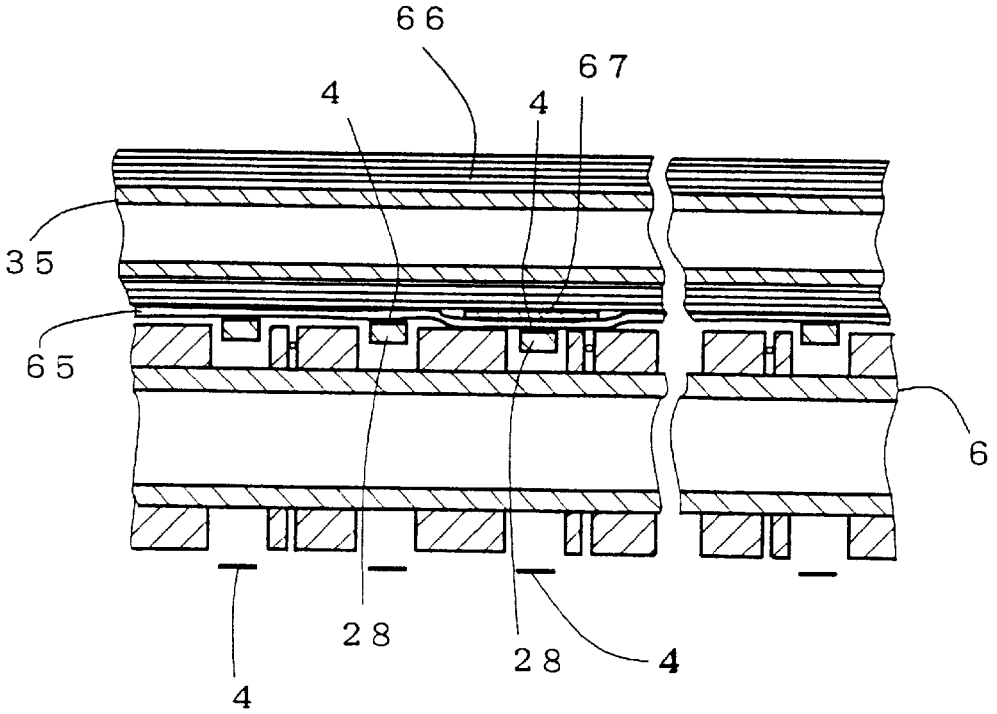
FIG. 14 is a fragmentary front view as seen in arrow direction from dash-and-dot line G—G of FIG. 13, showing a condition when a debris is wound with veneer sheet.
Figure 15:
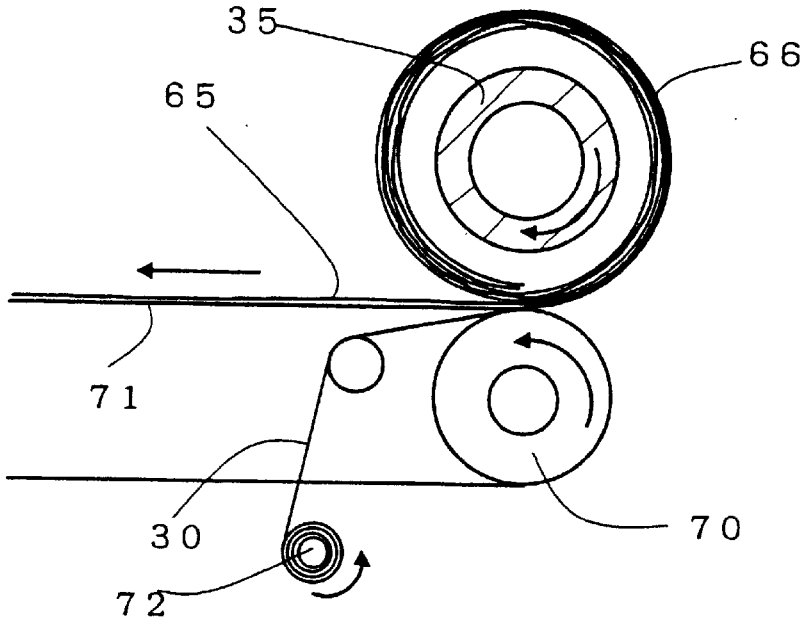
FIG. 15 is a fragmentary side illustrative view showing a process of unwinding veneer sheet from take-up reel.

Now reference is made to FIG. 14 showing a condition in which a debris 67, e.g. a piece of veneer produced by trimming with scarf knives provided on opposite sides of a veneer lathe (not shown), is present on veneer sheet 65. In such a case, veneer sheet 65 projects radially outward at the location where the piece 67 is caught between the sheet 65 and the veneer roll 66, and a belt 4 and touch rolls 5 adjacent such projection are forced downward, as clearly seen in FIG. 14. Accordingly, a gap is formed between the touch rolls 5 and veneer roll 66 in the area other than the projection. Though the belt 4 just below the debris 67 is forced down while pushing its associated piston rod 26*a*, all the belts 4 maintain pressing contact with veneer roll 66 with substantially the same pressure. Thus, trouble-free reeling operation is accomplished even when a veneer debris is caught and wound together with a veneer sheet.

Additionally, when the touch rolls 5 are forced down by the presence of any debris 67, the first arm 12 is swung and the load cell 20 may be pressed to such an extent that a load detected by the load cell 20 exceeds the set upward force by about 10 percent. However, since the debris 67 is usually a small piece which moves past the touch roll 5 rapidly before the take-up reel 35 makes a quarter turn, position of the reel 35 remains unchanged without being influenced by such debris.

Reeling operation is continued until the veneer roll 66 reaches a predetermined diameter. When the reeling has been completed, the take-up reel 35 with veneer roll 66 is removed from the carriages 51 and transferred to any location for the subsequent unreeling process. A manner of unreeling is exemplified in FIG. 15. The take-up reel 35 is rotatably supported by a pair of carriages (not shown) similar to the carriages 51 each having a V-shaped groove, and a plurality of belts 71 driven by a pulley 70 in arrow direction is pressed against the peripheral surface of veneer roll 66 with an appropriate pressure by any suitable means (not shown). By so doing, veneer roll 66 is rotated in unwinding direction as indicated by arrow. While veneer sheet 65 is being unreeled from roll 66, the threads 30 are unwound synchronously with the traveling speed of the belts 71 to be rewound on bobbins 72 each located below a space between any two adjacent belts 71.

Depending on the kind or species of veneer to be reeled, however, when veneer sheet 65 continues to be stressed between the belts 4 and veneer roll 66, the sheet 65 may be stretched in the region upstream of the veneer roll 66 to such an extent that the sheet movement is deviated from straightforward course along the belts 4 and also that stretching causes slack in the sheet 65 which may result in formation of folds as encountered in the conventional apparatus.

The following will describe a second embodiment of veneer reeling apparatus according to the invention which is designed as an improvement over the first preferred embodiment.

The second embodiment differs from the first preferred embodiment only in pneumatic system for the cylinders 26. For the sake of description, eight conveyer belts 4 are arranged in two groups; namely, four belts on the left-hand side as seen in veneer conveying direction (see FIG. 2) which will be referred to as belts of a first group, while the remaining four belts on the right-hand side as belts of a second group.

Figure 16:
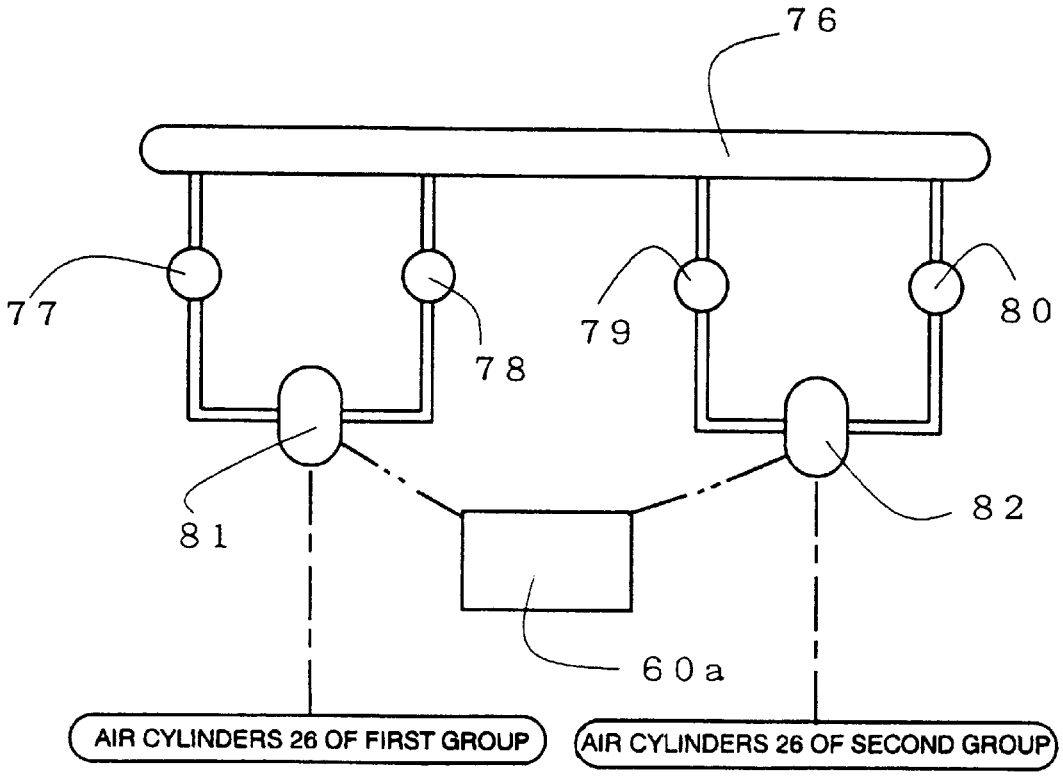
FIG. 16 is a schematic diagram showing a pneumatic system of another embodiment of veneer reeling apparatus according to the invention.

Referring to FIG. 16, the apparatus includes an air compressor 76 connected to two pairs of reducing valves 77, 78 and 79, 80 which are in turn connected to solenoid-operated valves 81, 82, respectively, for selectively changing the flow direction of air under reduced pressure. The solenoid valves 81, 82 are operatively connected to the air cylinders 26 for the conveying belts 4 of the first and second groups, respectively. For the sake of description, the cylinders 26 for the belts 4 of the first and second groups are referred to as cylinders of the first and second groups, respectively. The solenoid valves 81, 82 are electrically connected to a control 60*a*. It is noted that the control 60*a* performs the function of controlling the operation of the solenoid valves 81, 82, as will be described in detail below, as well as the control function as described with reference to the first preferred embodiment. The reducing valves 77 and 79 are adapted to reduce the pressure of compressed air from the air compressor 76 to a first pressure, while the reducing valves 78 and 80 to a second pressure. The first pressure adjusted by the reducing valves 77, 79 is of such a magnitude that, when introduced into each air cylinder 29 for the conveyer belts 4 of either one of the two groups, allows each such belt 4 to exert a pressing force of about 5 kilograms against the take-up reel 35 or veneer roll 66, namely 20 kilograms by four belts 4. The second pressure from the reducing valves 78, 80 is of such a magnitude that only supports the plate 28 for each belt 4 and allows each belt 4 to exert very little pressing force against the take-up reel 35 or veneer roll 66.

The following will describe operation of the apparatus of the second embodiment.

To initiate reeling operation of the apparatus, machine operator provides a start signal to the control 60*a* by manual operation on a control panel. In response to such signal, the control 60*a* operates the solenoid valves 81, 82 to establish flow lines that allow air under the first pressure to be supplied to the air cylinders 26 of the first group and air under the second pressure to the cylinders 26 of the second group, respectively. Then, the operator manually transmits a signal to start the motor (not shown) for the front pulley shaft 2, thus activating the conveyer belts 4. Upon starting the belts 4, the control 60*a* is operated to calculate moving distance of the belts 4 based on the information of belt running speed obtained from the rotary encoder 43 and time elapsed. When the moving distance according to the calculation becomes a predetermined valve, e.g. about 500 mm, the control 60*a* generates a command signal to simultaneously change the solenoid valves 81, 82 so that air under the second pressure is supplied to the air cylinders 26 of the first group and air under the first pressure to the cylinders 26 of the second group, respectively. Whenever the distance moved by the belts 4 reaches 500 mm as counted after the previous changing of the solenoid valves 81, 82, the control 60a operates to change the flow lines through the solenoid valves 81, 82. Thus, such alternating operation is repeated each time the conveyer belts 4 move a distance of about 500 mm.

In operation of the apparatus, when the air cylinders 26 of the first groups are supplied with the first pressure and the cylinders 26 of the second group with the second pressure, namely when the belts 4 of the first group are pressed against veneer roll 66 while the belts 4 of the second group are merely in touch therewith, slack tends to be produced in veneer sheet 65 behind the veneer roll 66 in the region of the belts 4 of the first group. Should the belt 4 of the first group maintain pressing contact with the veneer roll 66 for a long time, the slack may grow into a large wave which may result in the formation of harmful folds. According to this embodiment, however, wherein the pressure with which the belts 4 of the first group are pressed against the veneer roll 66 is reduced substantially zero after the belts 4 has moved a distance of about 500 mm, the veneer sheet 65 is subjected no more to a stressing force in the region of the first group conveyer belts 4, and the veneer sheet 65 is wound as slackened without the slack being accumulated into a large wave form.

If winding of veneer sheet 65 as slackened is continued in either one end portions of veneer roll 66 because of occasional specific property of the veneer sheet being reeled, the above one end portion of veneer roll 66 becomes larger in diameter than the other end portion, so that the veneer roll may result in a slightly tapered form. In such a case, the touch rolls 5 are forced by the larger end of the taper and, if load applied to the load cell 20 is increased to exceed the set upward force by about 10 percent, the reel carriages 51 are elevated until the load is reduced less than the set upward force. Such movement of the carriages 51 is repeated until the slack is produced and wound no more and, therefore, the veneer roll 66 becomes substantially cylindrical. Veneer roll 66 thus formed has one end portion loosely wound than the other end portion.

As a matter of course, the take-up reel carriages 51 are raised in the above embodiment in the same manner as in the first preferred embodiment in accordance with signals which are generated by the load cell 20 to the control 60 and representative of an increment in diameter of a veneer roll 66.

Figure 17:
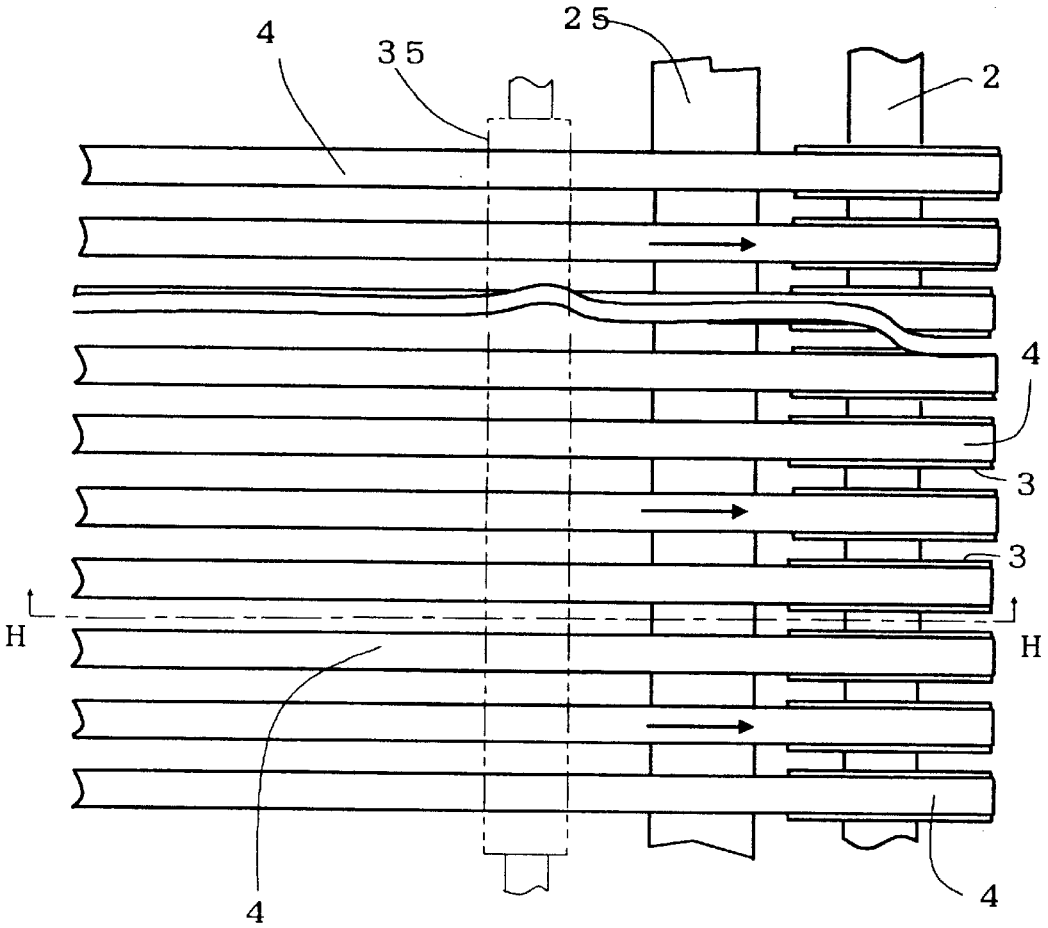
FIG. 17 is a fragmentary plan view of still another embodiment of veneer reeling apparatus according to the present invention.
Figure 18:
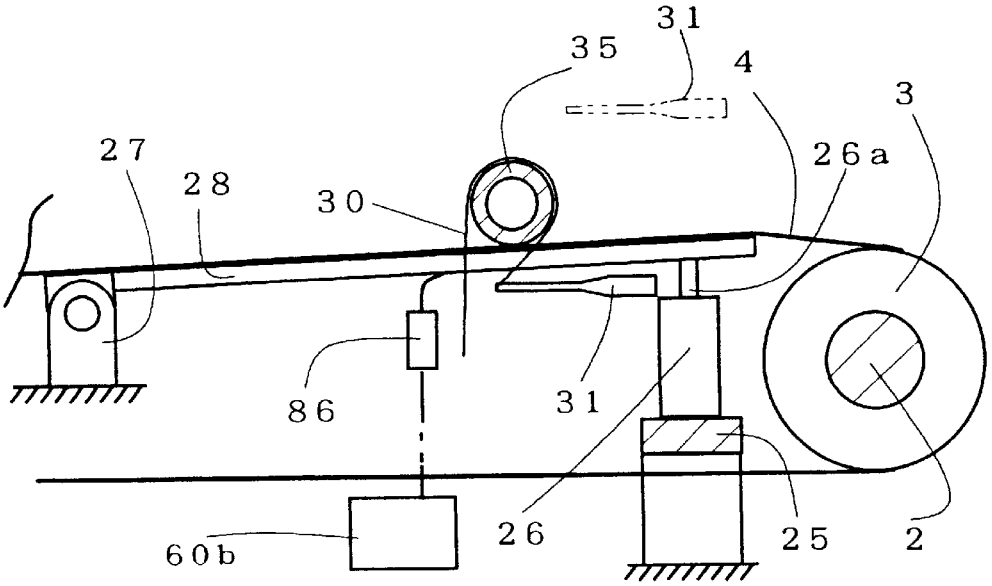
FIG. 18 is a fragmentary side view as seen in arrow direction from dash-and-dot line H—H of FIG. 17.

The following will describe a third embodiment of veneer reeling apparatus according to the invention with reference to FIGS. 17 and 18, wherein elements corresponding to elements of the first embodiment are designated by like reference numerals. The third embodiment differs from the first embodiment primarily in that it dispenses with the touch roll assembly 6 and its associated parts such as first and second arms 12, 18, load cell 20 and cylinder 19.

Referring to FIG. 17, the apparatus comprises a plurality of conveyer belts 4 which are similar to, but more in number than those in the first embodiment and spaced at smaller intervals. Each belt 4 is trained round a front pulley 3 mounted on a common drive shaft 2 and driven by a motor (not shown). As shown in FIG. 18, there is provided a support base 25 extending behind the pulley 3 and straddling the lower legs of the conveyer belts 4. On the support base 25 are fixed an air cylinder 26 corresponding to each belt 4. Each belt 4 has on its inner surface a backup plate 28 having substantially the same width as the belt 4 and rotatably supported at the upstream end thereof by a bearing 27. Each cylinder 26 is charged with air under pressure, the magnitude of which is established such that the piston rod 26*a* of the cylinder 26 pushes the plate 28 to such an extent that each belt 4 is pressed against the take-up reel 35, or veneer roll 66, with a predetermined upward force, namely about 20 kilograms by all the belts 4. It is noted that the piston rod 26*a* is extended partially out of its cylinder 26 and engaged in pressing contact with its associated plate 28 so that, when the take-up reel 35 is moved slightly upward, the piston rod 26*a* can extend further to keep contact engagement with the plate 28 with substantially the same force, thereby keeping the belts 4 to be in pressing contact with the take-up reel 35 or veneer roll 66.

A limit switch 86 is fixed to a frame (not shown) at any appropriate position where it can be stricken or turned on by a plate 28 for any one of the belts 4 when it is moved down together with its associated belt 4 to a predetermined position. As indicated by phantom line in FIG. 18, the limit switch 86 is electrically connected to a control 60*b* to generate thereto a signal when the switch 80 is turned on. Additionally, a plurality of thread nozzles 31 is disposed adjacent the take-up reel 35 between any two selected adjacent belts 4 for feeding therefrom a thread 30 as in the first embodiment.

The control 60*b* operates on the motor 41 (FIG. 1) for controllably driving the screws 38 (FIG. 1) as follows.

When the limit switch 43 is turned on by the plate 28 lowering together with its belt 4 while the carriages 51 are moving downward and the pulley drive shaft 2 kept at a stop, the control 60*b* then responding to a signal from the limit switch 86 generates a command signal to stop the motor 41 and then to operate the motor so as to rotate the screws 38 in the direction that causes the carriages 51 to be elevated until the limit switch 86 generates the signal no more.

On the other hand, when the limit switch 86 is actuated while the pulley drive shaft 2 is being rotated and also if the limit switch 86 remains on while the take-up reel 35 rotates, e.g., a quarter of a complete turn thereof, the control 60*b* generates a signal commanding the motor 41 to operate to rotate the screws 38 in the direction that causes the carriages 51 to be elevated. This elevation is continued until the limit switch 86 is turned off and also if this condition continues while the take-up reel 35 makes a quarter turn.

The apparatus of the third embodiment is set in its initial state as follows.

With the pulley drive shaft 2 kept at a stop, the machine operator manually starts the motor 41 to rotate the screw 38, bringing the carriages 51 to a position higher than that shown in FIG. 1. After the take-up reel 35 is set in position on the carriages 51, the screws 38 are rotated to lower the carriages 51 with the reel 35. As the take-up reel 35 is brought into pressing contact with the conveyer belts 4, the plates 38 are swung down while forcing the piston rod 26*a* into the cylinder 26. By allowing the take-up reel 35 to move further downward, the limit switch 86 is turned on and, therefore, the control 60*b* generates a signal commanding the motor 41 to stop and then to operate to rotate the screws 38 in the direction that causes the take-up reel 35 to be raised. As described earlier, when the limit switch 86 is turned off, the motor 41 is stopped and the upward movement of the take-up reel carriages 51 is also stopped. As a result of the above manual operation, the take-up reel 35 is set in its initial state position as shown in FIG. 18.

Veneer reeling is initiated with threads 30 previously located over the take-up reel 35 and the nozzles 31 shifted to the position indicated by solid line as shown in FIG. 18. As the reeling operation continues and a veneer roll 66 increases its diameter, the belts 4 and the plates 28 are forced down until the limit switch 86 is stricken by one of the plates 28. If the limit switch 86 remains on while the take-up reel 35 rotates a quarter of its complete turn, the control 60*b* is operated to generate a signal to the motor 41, which in turn rotates the screws 38 in the direction that causes the carriages 51 to be elevated with the take-up reel 35. The elevation of the carriages 51 is continued until the limit switch 86 is turned off and also if this off condition remains while the take-up reel 35 makes a quarter turn.

If a debris 67 present on an incoming veneer sheet 65 is wound together therewith, belts 4 adjacent such debris are forced down while forcing the piston rods 26*a* into the cylinders 26, but all the belts 4 maintain pressing contact with the veneer roll 66 with substantially the same pressure as in the first embodiment and, therefore, the veneer roll 66 rotates substantially at a constant peripheral speed. Though the limit switch 86 may be actuated by the presence of any debris 67 wound with veneer sheet 65, the position of the take-up reel 35 remains unchanged without being influenced by such debris 67 because it is usually a small piece moving past the contact area between the belt 4 and the veneer roll 66 rapidly before the reel 35 makes a quarter turn.

As is apparent to those skilled in the art, the arrangement described with reference to FIG. 16 may be employed in the above third embodiment.

The following will further describe other various embodiments and modifications of the invention, wherein elements corresponding to elements of the above embodiments are designated by like reference numerals.

Figure 19:
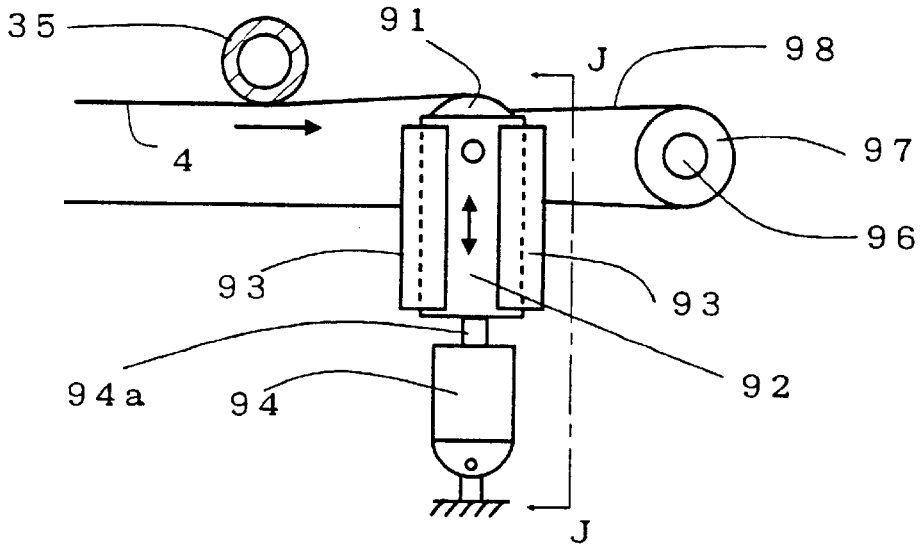
FIG. 19 shows another embodiment of veneer reeling apparatus of the invention.
Figure 20:
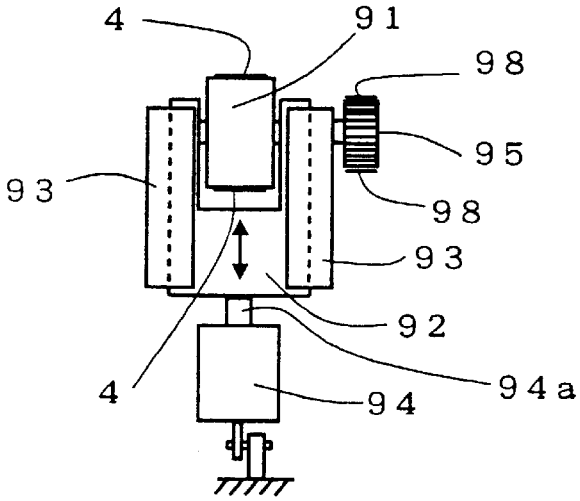
FIG. 20 is a front view as seen in arrow direction from dash-and-dot line J—J of FIG. 19.

(1) FIGS. 19 and 20 show an embodiment which dispenses with touch rolls 5, as well as plates 28 urged by cylinders 26 for pressing the belts 4 against the take-up reel 35 or veneer roll 66.

In this embodiment, a series of pulleys 91, which are fixedly mounted on a common pulley shaft and round which conveyer belts 4 are trained, is rotatably supported by bearings (not shown) in the respective pulley support blocks 92. Each support block 92 is in turn vertically movably guided by a guide member 93 fixed to a frame (not shown). Disposed below the pulley support block 92 is an air cylinder 94 having a piston rod 94*a* pressed against the support block 92. As shown in FIG. 20, a gear 95 is fixed on the pulley shaft and operatively connected by a cogged belt 98 with another gear 97 fixed on a shaft 96 driven by a common stationary motor (not shown). Thus, the pulleys 91 are allowed to move vertically along the guide member 93 while being driven from the motor. As apparent from FIG. 19. the take-up reel 35 or veneer roll 66 is rotatable by friction due to contact with the belts 4 driven by the pulleys 91. Air pressure in the cylinders 94 is established so that the take-up reel 35 or veneer roll 66 receives a pressing force of about 20 kilograms from the belts 4 irrespective of the position of the piston rod 94*a* relative to its cylinder 94 as in the first to third embodiments.

To detect the displacement of belt 4 caused by an increase in diameter of veneer roll, a limit switch similar to the switch 86 of FIG. 18 may be provided to be actuated by contact with the belt 4.

Figure 21:
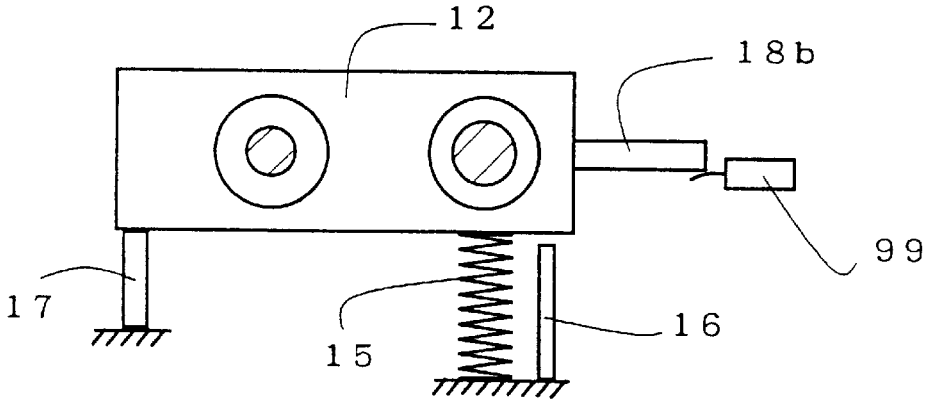
FIG. 21 is a schematic side view showing still another embodiment of veneer reeling apparatus of the invention.

(2) Load cell 20 used in the first and second embodiments may be replaced by a limit switch 99 arranged so as to be actuated by an arm 18*a* fixed to the first arm 12 for movement therewith, as shown in FIG. 21. Though a limit switch may be inferior to a load cell in detecting accuracy, it serves for the purpose in reeling a relatively thick sheet of veneer.

(3) Air cylinder 26 in the first embodiment may be substituted by a compression spring constructed and disposed to exert a force that keeps the belts 4 in pressing contact with the take-up reel 35 or veneer roll 66.

(4) In the third embodiment of FIGS. 17 and 18, air cylinder 26 may be replaced by a compression spring if the conveyer belts 4 are not arranged into two groups for alternately changing the pressure acting on the belts 4 as in the second embodiment.

(5) Instead of the limit switch 86 used in the third embodiment, a reflective type photoelectric switch may be employed for detecting downward displacement of belt 4 caused by an increase in diameter of veneer roll 66.

(6) As means for detecting an increment of veneer roll diameter, a laser beam may be employed which is directed toward the axial center of the take-up reel 35 so that the beam is emitted against the outer peripheral surface of veneer roll 66 and reflected beam is received for determining a progressive increase of veneer roll diameter.

(7) While in the second embodiment and a modification of the third embodiment the first and second pressures of the cylinders 26 acting on the belts 4 of two different groups are alternately changed each time the belts 4 move a distance of about 500 mm, this distance may be changed as required depending on the species of veneer or thickness of veneer sheet to be reeled. Alternatively, changing between the first and second pressures may be performed after elapse of a predetermined length of time.

(8) While in the first embodiment the cylinder 19 is charged with air under pressure of a magnitude that allows the touch rolls 5 to be pressed against the take-up reel 35 or veneer roll 66 with a force of about 5 kilograms, this pressure may be changed as required depending on the species of veneer or thickness of veneer sheet.

(9) Likewise, the pressure in the air cylinders 26 for urging the conveyer belts 4 against the take-up reel 35 or veneer roll 66 in the first and second embodiments may be changed as required depending on the species veneer or thickness of veneer sheet.

(10) It is known to those skilled in the art that threads 30 serve as effective guide in winding in particular a weak veneer sheet or discrete veneer sheets cut previously into any desired size and fed successively. When winding a relatively strong veneer sheet, however, the reeling apparatus may dispense with thread nozzles 31. In this case, initial reeling of veneer sheet round the take-up reel 35 may be manually performed by winding a couple of turns of the leading end portion of the sheet and then initiating automatic reeling with the conveyer belts 4 activated.

(11) In the first to third embodiments, for the control to provide a command signal to the motor 41 for elevating the take-up reel 35 and also for stopping its elevation, it is required that the reel 35 should make a quarter turn while the load cell 20 or the limit switch 86 remains its actuated state. If there is no fear of a debris being wound with veneer sheet, however, the requirement of time for the take-up reel 35 to make a quarter turn may be eliminated. Alternatively, the time may be changed depending on working conditions.

(12) In the second embodiment and a modification of the third embodiment each having two different groups of conveying belts 4, it may be so arranged by further modification thereof that any selected number of belts 4, as counted from the respective sides of the array of belts 4, are associated with air cylinders 26 of the first and second groups connected to the solenoid valves 81 and 82, respectively, so that the first and second pressures of the cylinders 26 acting on the selected belts 4 are alternately changed each time the belts 4 move a predetermined distance. In such a case, the remaining intermediate belts 4 should be arranged so as to receive a substantially constant force corresponding to the first pressure of the cylinder.

(13) The pair of screws 38 as means for moving the take-up reel carriages 51 may be substituted by other means such as air cylinders.

Figure 22:
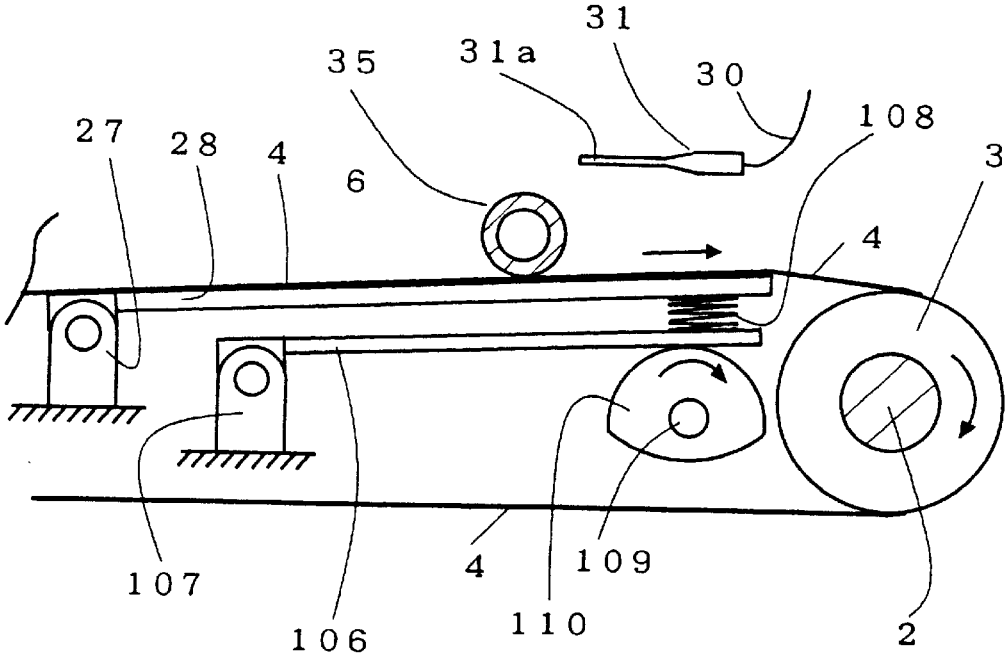
FIGS. 22 and 23 are schematic side views showing a further embodiment of veneer reeling apparatus of the invention.
Figure 23:
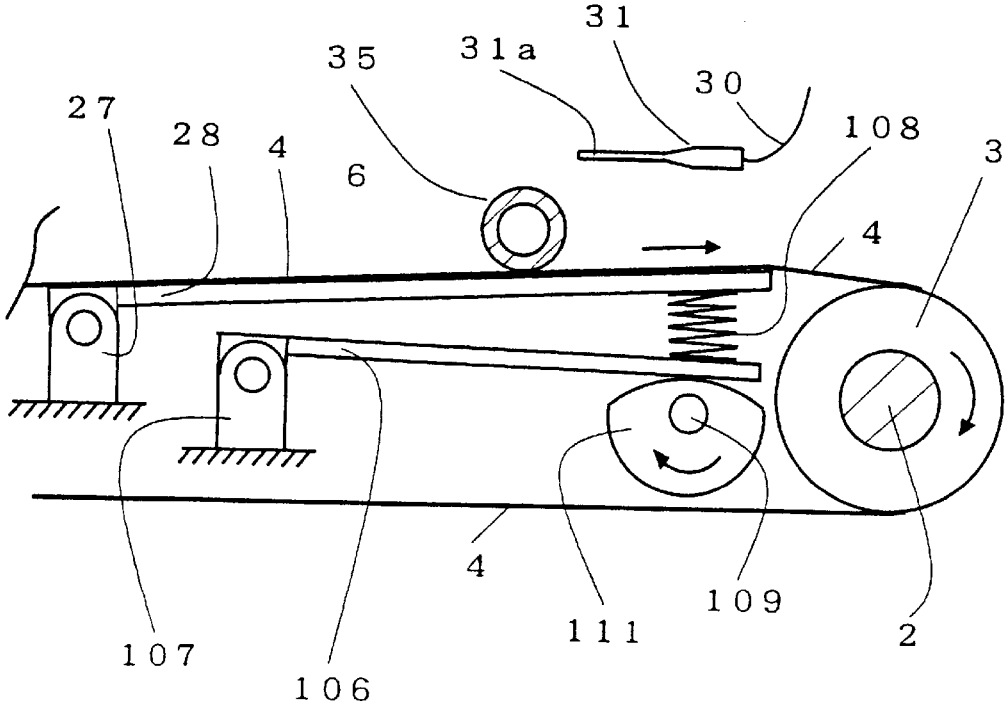

(14) Referring to FIGS. 22 and 23, these illustrate an embodiment which operates in a manner similar to the second embodiment, wherein air cylinder 26 as means for pressing belts 4 against the take-up reel 35 or veneer roll 66 is replaced by cam and compression spring.

In the drawings, reference numeral 106 designates a swingable plate located just below each plate 28 and swingably supported by a bearing 107. A compression spring 108 is fixedly mounted between the distal end portions of the two plates 28 and 106. For the sake of description, the plate 28 is referred to as first plate and the plate 106 as second plate, respectively, hereinafter. A shaft 109 extends below the second plate 106 where the spring 108 is fixed. The shaft 109 is rotatably supported by stationary bearings (not shown) and driven by a servo motor (not shown). In this embodiment, there is provided a total of 16 conveyer belts 4 which are arranged into first and second groups as in the second embodiment (FIG. 16). A cam 110 as shown in FIG. 22 is fixedly mounted on the shaft 109 for rotation therewith for each plate 28 for the first group conveyer belts 4 and a cam 111 is fixed on the same shaft 109 for each plate 28 for the second group belts 4. As seen from comparison of FIGS. 22 and 23, the cams 110 and 111 have the same profile, but are disposed in symmetrical arrangement such that one of the cams 110 and 111 is in a position rotated by a half turn from that of the other cam.

In a position of the apparatus as shown in FIGS. 22 and 23, the second plates 106 are raised by the cams 110 while compressing the springs 108 thereby to urge the first plates 28 upward, so that belts 4 of the first group are pressed against the take-up reel 35 with a relatively large force, while the second plates 106 for the second group are in their lowered position with the springs 108 less compressed so that belts 4 of the second group are pressed against the reel 35 with a relatively small force. The magnitude of forces applied to the take-up reel 35 in the above two positions of the cams 110 and 111 may be determined by selecting springs with the desired spring constant.

There is provided a control (not shown) which is operable to generate a signal commanding a motor (not shown) to rotate the shaft 109 a half turn after the belts 4 move a predetermined distance, e.g., about 500 mm. Thus, the conveyer belts 4 of the first and second groups press the take-up reel 35 with a large force and a small force alternately each time the belts 4 the above distance. Thus, the apparatus of this embodiment provides an effect similar to that obtained in the second embodiment.

Figure 24:
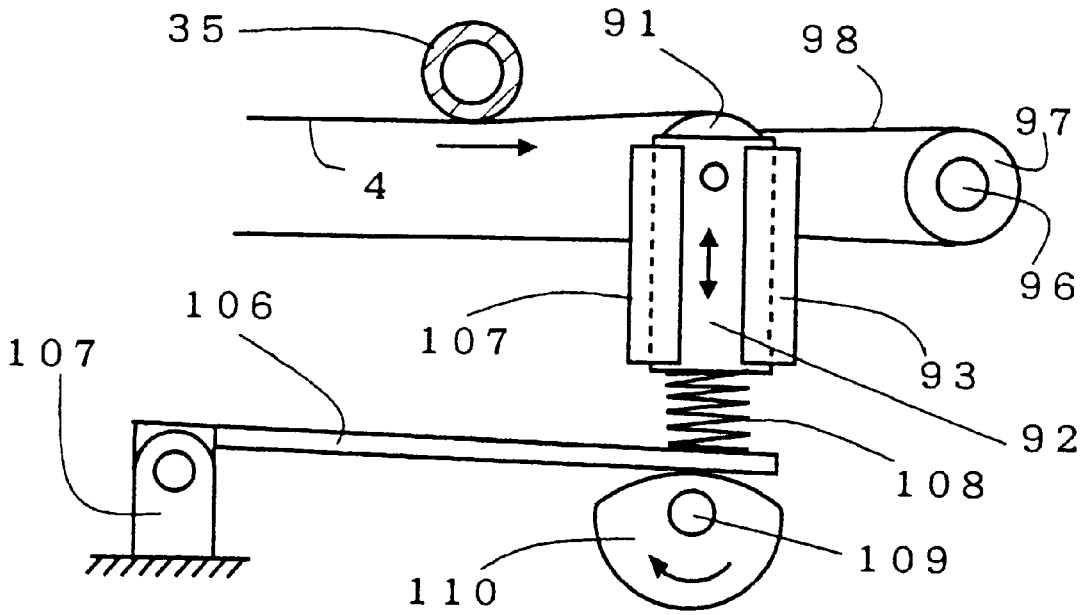
FIG. 24 is a schematic side view showing still another embodiment of veneer reeling apparatus of the invention.

(15) Referring to FIG. 24, this shows an embodiment combining the features of the embodiments of FIG. 19 and of FIGS. 22 and 23. Namely, the air cylinder 94 (FIG. 19) is replaced by a plate 106 supported by bearing 107, a compression spring 108 and cams 110 and 111 fixedly mounted on a shaft 109 driven by motor (not shown) of FIGS. 22 and 23. The conveyer belts 4 are arranged into first and second groups of belts which are pressed against the take-up reel 35 with large and small forces alternately.

(16) In the above-described embodiments, the take-up reel 35 is adapted to be elevated by rotating the screws 38 in accordance with an increase in diameter of veneer roll 66. It may be so arranged, however, that the take-up reel 35 is provided stationary and, instead, the conveyer belts 4 are movable with a diametrical increase of veneer roll 66.

Figure 25:
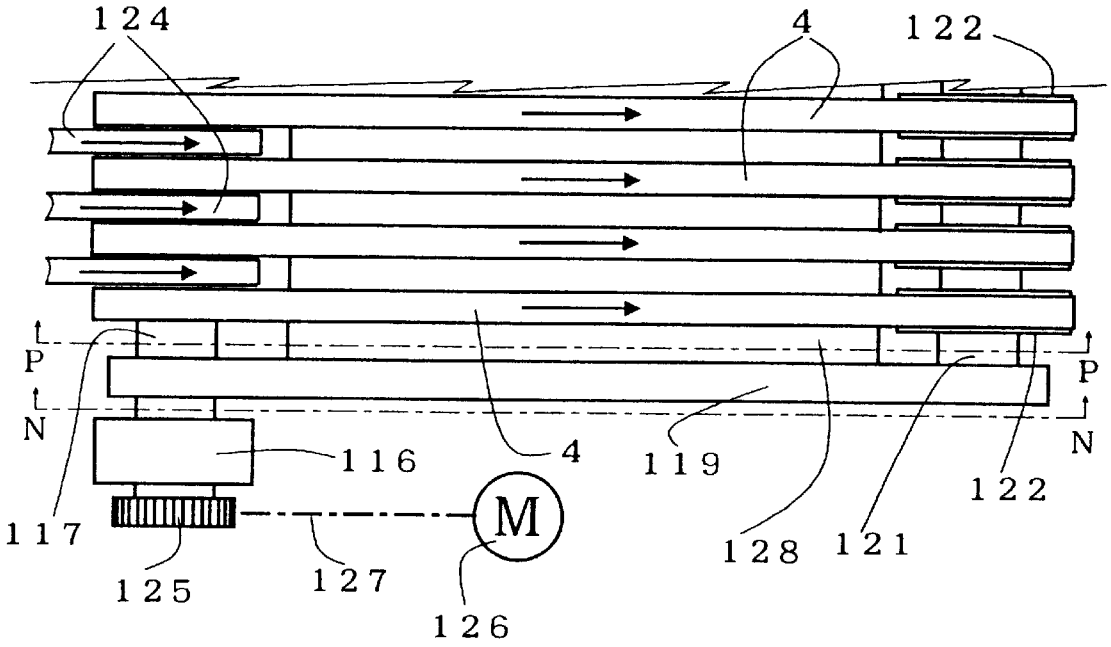
FIG. 25 is a fragmentary plan view showing still another embodiment of veneer reeling apparatus according to the present invention.
Figure 26:
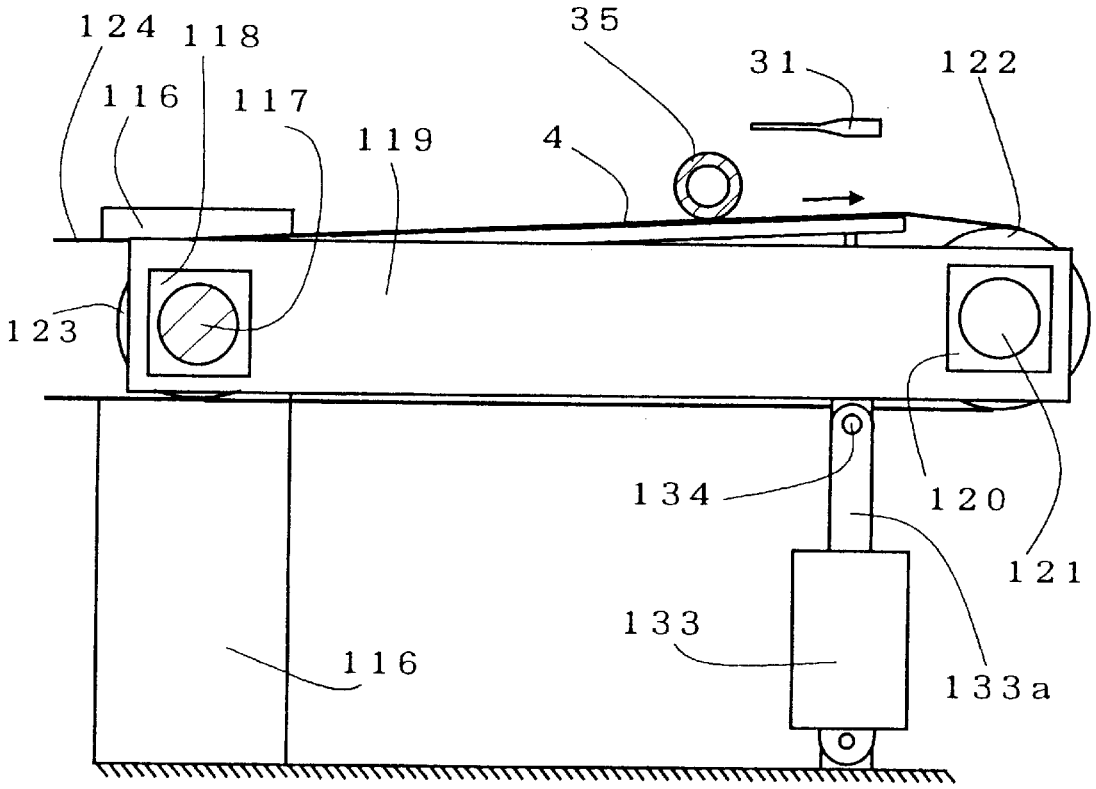
FIG. 26 is a side view as seen in arrow direction from dash-and-dot line N—N of FIG. 25.
Figure 27:
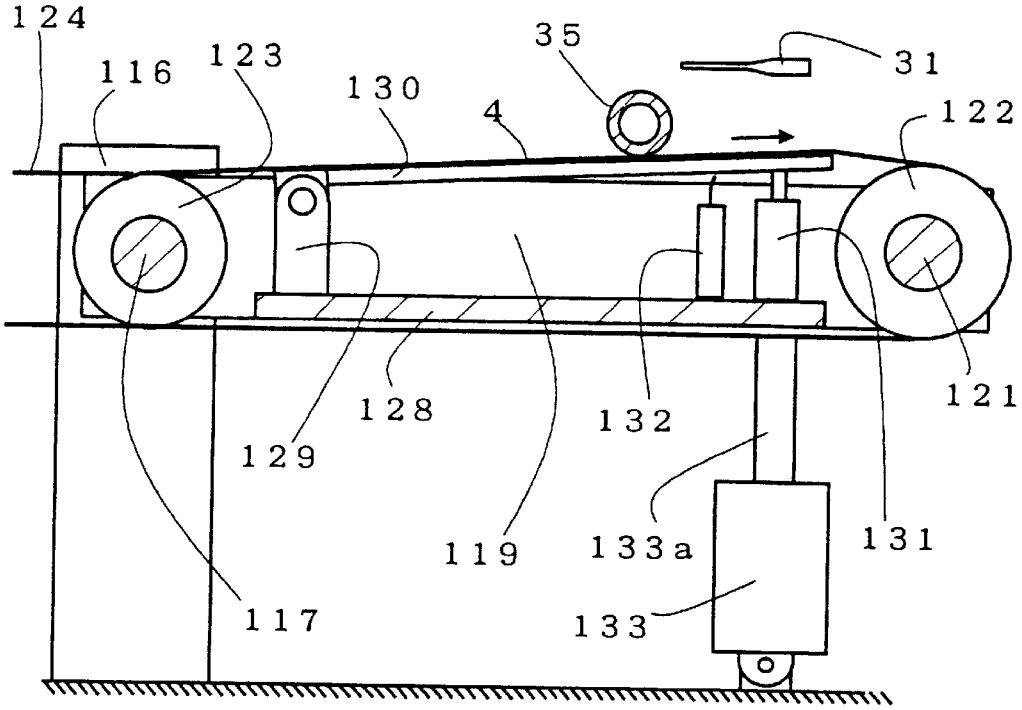
FIG. 27 is a side view as seen in arrow direction from dash-and-dot line P—P of FIG. 25.

Referring to FIGS. 25, 26 and 27, reference numeral 116 designates a pair of uprights disposed on opposite sides of an array of conveying belts 4. These belts 4 are arranged into two groups as in the second embodiment (FIG. 16). A freely rotatable shaft 117 is supported at its end portions by bearings (not shown) in the uprights 116 and a pair of arms 119 (only one shown) is swingably mounted at the proximal ends thereof on the shaft 117 via bearings 118. A shaft 121 is freely rotatably supported by bearings 120 in the distal end portion of each arm 119 and carries thereon a series of spaced pulleys 122, namely as many as 16 pulleys. On the other hand, the shaft 117 carries thereon the same number of pulleys 123 (FIG. 27) and each of the belts 4 is trained round the corresponding pulleys 122 and 123.

Though not shown fully in the drawings, a pulley is mounted on the shaft 117 between each two adjacent pulleys 123 and a belt 124 is trained over the former pulley and its corresponding pulley (not shown) located at upstream end of the upper leg of the belt 124. A sprocket wheel 125 is fixed on one end of the shaft 117 and operatively connected to a motor 126 by chain 127 for driving the shaft 117, thus moving the conveyer belts 4 and 124 in arrow direction.

A support plate 128 is attached between the arms 119 at their bottoms for swinging therewith. A plate 130, similar to the plate 28 of the first embodiment, having the same width as the belt 4 is disposed just below each belt 4 and supported swingably about a bearing 129. An air cylinder 131 is fixed on the above support plate 128 at such a position that its piston rod, when extended, is engageable with the lower surface of each plate 130 at its distal end portion. These air cylinders 131 are grouped to correspond to the first and second groups of conveyer belts 4 and arranged in the manner as described with reference to FIG. 16 so that the cylinders 131 are alternately supplied with the first and second pressures. Two limit switches 132 (only one shown) are also fixed on the support plate 128 just below the plates 130 at the opposite outermost sides of the array of belts 4. Furthermore, below each of the swingable arms 119 is provided another air cylinder 133 having its piston rod 133*a* connected by a pin 134 to the bottom of the arm 119. Each air cylinder 133 is charged with air under pressure of such a magnitude that allows its piston rod 133*a* to be fully extended and support the swingable arm 119 substantially horizontally as shown in FIG. 26. After thus being charged with air under pressure, the inlet port of the cylinder 133 is closed.

It is noted that the take-up reel 35 is supported at a position shown in FIGS. 26 and 27 and it remains in that position without moving vertically during veneer reeling operation.

As veneer reeling is initiated and veneer roll 66 grows gradually to increase its diameter, the force with which the veneer roll 66 presses against the belts 4 is increased and the belts 4 and the plates 130 are forced down gradually from the initial position to reduce the spaced distance between the plates 130 and the support plate 128. When the plates 130 are moved enough to strike the limit switch 132 on the support plate 128, the control (not shown) then responding to a signal from the limit switch 132 generates a command signal to open the outlet port of the cylinders 133 thereby to reduce the air pressure therein. The piston rod 133*a* is moved into the cylinder 133 and the arms 119 are swung downward together with the pulleys 122. Though the spaced distance between the support plate 128 and the veneer roll 66 is increased, the plates 130 urged upward by the cylinders 131 are not lowered with the arms 119, so that the limit switches 132 are moved away from the plates 130 and then clear thereof. The control then responding to a signal from the limit switches 132 cleared of the plates 130 is operated to close the outlet port of the cylinders 133 and, therefore, the movement of the piston rod 133*a* into the cylinder 133 is stopped. Accordingly, the arms 119 stop their downward swinging and supported by the cylinders 133 at a position slightly lowered from the initial horizontal position.

Each time the veneer roll 66 becomes large enough to actuate the limit switch 132, the above operation is repeated to lower the arms 119 gradually. After a complete veneer roll 66 is formed and removed from the apparatus, the cylinders 133 are recharged with air under the above pressure for the next reeling operation.

(17) In the first and second embodiments, the touch rolls 5 are arranged to be freely rotatable and driven to rotate by frictional force from the take-up reel 35 or veneer roll 66. Depending on the species of veneer, the peripheral speed of veneer roll 66 may be reduced relative to the conveying speed of the belts 4 because of resistance offered by the touch rolls 5, with the result that a difference may occur between the feeding speed of veneer sheet 65 moved by the belts 4 and the peripheral speed of veneer roll 66. Such difference in speed may cause slack in the veneer sheet 65 upstream of the touch rolls 5, which in turn produces harmful folds in the sheet.

To prevent the touch rolls 6 from being slowed down, it may be so arranged that the rolls are positively driven by a motor so that they are rotated in the same direction as the belts 4 and at a peripheral speed that is slightly higher than the traveling speed of the belts 4.

(18) While veneer sheet 65 is wound together with threads 30 in the preceding embodiments, gum tapes may be used instead which are fed from any appropriate position upstream of the take-up reel 35 and applied to the sheet 65 to be wound therewith. The use of such adhesive tapes can help to strengthen the veneer sheet 65.

While the invention has been described and illustrated with reference to the specific embodiments, it is to be understood that the present invention can be practiced in other various changes and modifications without departing from the spirit or scope thereof.

What is claimed is:

1. A veneer reeling apparatus for winding a veneer sheet into a veneer roll, comprising:

a freely rotatable take-up reel for winding the veneer sheet into the veneer roll;

a plurality of spaced conveyor belts extending below said take-up reel, perpendicular to the axis of the take-up reel, the conveyor belts for being driven to move in a direction to advance a veneer sheet placed on said belts toward said take-up reel;

means for moving said take-up reel toward and away from said belts;

first means for urging each of said belts toward said take-up reel to keep the belts in resiliently pressing contact with the veneer roll, to frictionally drive the veneer roll;

detecting means for detecting an increment in diameter of the veneer roll during reeling;

said detecting means including a roll member disposed below said take-up reel and said belts and extending parallel to said take-up reel, second urging means for urging said roll member in resiliently pressing contact with the veneer roll, said roll member being movable away from said reel as the veneer roll increases the diameter of the veneer roll during reeling operation, and force detecting means responsive to the movement of said roll member for detecting the force with which said roll member presses against the veneer roll, said force detecting means being operable to generate a signal upon detection of a predetermined magnitude of force in response to an increase in diameter of the veneer roll; and a control operable in response to the signal from said force detecting means to generate a command signal to activate said take-up reel moving means to move said take-up reel away from said belts to compensate for the increment.

2. Apparatus according to claim 1, wherein said force detecting means includes a load cell.

3. Apparatus according to claim 1 or 2, wherein said control is operable to generate said command signal to activate said reel moving means when the take-up reel has continued to rotate for a predetermnined length of time after said force detecting means had generated the signal to said control.

4. Apparatus according to claim 3, wherein said predetermined length of time corresponds to a quarter of a complete turn of said take-up reel.

5. Apparatus according to claim 1 or 2, wherein said take-up reel moving means includes a pair of synchronously movable carriages removably supporting said take-up reel at the opposite end portions thereof, gearing engaged with said carriages and a motor for driving said gearing in response to the command from said controller to move said carriages synchronously upward.

6. Apparatus according to claim 1 or 2, wherein said roll member has a plurality of roll sections corresponding to spaces between any two adjacent belts, said roll sections being resiliently pressed against the veneer roll by said second urging means.

7. Apparatus according to claim 1 or 2, wherein said roll member is freely rotatable.

8. Apparatus according to claim 1 or 2, wherein said roll member is driven in the direction that aids in rotating the veneer roll.

* * * * *

UNITED STATES PATENT AND TRADEMARK OFFICE

CERTIFICATE OF CORRECTION

PATENT NO. : 6,173,918 B1 
DATED : January 16, 2001
INVENTOR(S) : Masaru Koike and Yukinobu Kuno It is certified that error appears in the above-identified patent and that said Letters Patent is hereby corrected as shown below:

Column 5,
Line 33, please delete “control 60a signal” and insert therefor -- control 60 a signal --;

Column 8,
Lines 49-50, please delete “sheet 63” and insert therefor -- sheet 65 --;

Column 14,
Lines 18-19, please delete “FIG. 19.” and insert therefor -- FIG. 19, --;
Line 27, please insert -- 66 -- after “veneer roll”.

Signed and Sealed this

Twenty-seventh Day of August, 2002

*Attest:*

*Attesting Officer*

JAMES E. ROGAN
*Director of the United States Patent and Trademark Office*